US007032765B2

(12) United States Patent
Miller et al.

(10) Patent No.: US 7,032,765 B2
(45) Date of Patent: Apr. 25, 2006

(54) CONTAINER WITH OVER CENTER CORNER LATCHES

(75) Inventors: Daniel R. Miller, Cincinnati, OH (US); Paul J. Ficker, Cincinnati, OH (US)

(73) Assignee: Buckhorn, Inc., Milford, OH (US)

( * ) Notice: Subject to any disclaimer, the term of this patent is extended or adjusted under 35 U.S.C. 154(b) by 460 days.

(21) Appl. No.: 10/369,731

(22) Filed: Feb. 21, 2003

(65) Prior Publication Data

US 2004/0011787 A1 Jan. 22, 2004

Related U.S. Application Data

(60) Provisional application No. 60/358,435, filed on Feb. 22, 2002.

(51) Int. Cl.
*B65D 6/16* (2006.01)

(52) U.S. Cl. ..... 220/7; 220/326; 220/652; 220/654

(58) Field of Classification Search ..... 220/326, 220/7, 652, 654, 428; 292/71
See application file for complete search history.

(56) References Cited

U.S. PATENT DOCUMENTS

| | | | | |
|---|---|---|---|---|
| 4,240,646 | A * | 12/1980 | Scott | 280/30 |
| 4,662,532 | A * | 5/1987 | Anderson et al. | 220/7 |
| 4,735,331 | A * | 4/1988 | Keenan et al. | 220/6 |
| 4,917,255 | A * | 4/1990 | Foy et al. | 220/6 |
| 5,193,706 | A * | 3/1993 | Hanna et al. | 220/234 |
| 5,330,067 | A * | 7/1994 | Gronnevik | 220/7 |
| 5,482,223 | A * | 1/1996 | Bresina et al. | 242/348.4 |
| 5,938,059 | A | 8/1999 | Luburic | |
| 6,073,790 | A * | 6/2000 | Umiker | 220/6 |
| 2003/0116564 | A1* | 6/2003 | Overholt et al. | 220/7 |
| 2003/0168866 | A1* | 9/2003 | Evans | 292/71 |

FOREIGN PATENT DOCUMENTS

| | | |
|---|---|---|
| EP | 0 662 426 A1 | 7/1995 |
| WO | WO 00/02787 | 1/2000 |

OTHER PUBLICATIONS

Joseph Edward Shigley, Mechanical Engineering Design, Copyright 1989, Mcgraw Hill, Inc., 5th Ed., p. 748.*

* cited by examiner

*Primary Examiner*—Nathan J. Newhouse
*Assistant Examiner*—Eugene Lhymn
(74) *Attorney, Agent, or Firm*—Mattingly, Stanger, Malur & Brundidge, P.C.

(57) ABSTRACT

A container constructed of parts that are injection molded using a synthetic resin molding technique includes a base, side walls and end walls. The side and end walls are movable between a first position in which the side and end walls are collapsed in the interior of the base and a second position in which the side and end walls are erect for being engaged at the corners by over center latches that are also molded of a synthetic resin material. The latches fit within recessed areas of the side or end walls such that when the latches are in a locked or unlocked position, the latches are contained entirely within a recessed area, which is recessed with respect to the exterior surface of the walls. Thus, when the latches are in the latched or unlatched position, the latches do not project outwardly beyond the exterior surface of the walls.

10 Claims, 34 Drawing Sheets

CONTAINER WITH OVER CENTER CORNER LATCHES

This application claims the benefit of Provisional Application No. 60/358,435, filed Feb. 22, 2002.

BACKGROUND OF THE INVENTION

1. Field of the Invention

The invention relates to a container that is designed for hauling bulk goods, such as tobacco.

2. Description of Related Art

A container for hauling bulk goods, such as tobacco, is required to transport tobacco from a tobacco auction house or warehouse, for example, to tobacco processing plants. It is important to transport such bulk goods in secure containers that are sufficiently large to use the cargo space of a typical trailer. Further, since the containers are of a large size, re-use of the containers is important in order to provide economical transportation of the bulk goods.

Knock down bulk containers are known in general, and have the advantage that the side and end walls of the container can be erected when the container is to be used, but otherwise the container can be shipped or stored in an unassembled state to save space. Specifically, bulk containers are known that can be shipped and stored in a knocked down state and assembled when needed for use as a container.

In U.S. Pat. No. 5,094,356 to D. Miller, a knock down bulk box is disclosed in which the side and end walls are pivotally mounted to the base along the edges of the base. A full sized container can be formed by erecting each of the side and end wall panels of the container to their upright position, and by joining the adjacent panels together at the corners of the container.

SUMMARY OF THE INVENTION

It is an object of the invention to provide a container that is capable of use in the transportation of bulk goods, such as tobacco. Preferably, the width of the container is approximately the same as that of the width of a trailer used to haul the container, which is for example 96"–102" wide.

It is an object of the invention to provide a container that is constructed of parts that are injection molded using a synthetic resin molding technique that includes molding the base, side walls and end walls of a synthetic resin material. Further, the side and end walls are joined together at the corners of the container by latches that are preferably molded of a synthetic resin material.

Further, it is an object of the invention to provide the latches within recessed areas of the side or end walls such that when the latches are in a locked or unlocked position, the latches are contained entirely within the recessed area, which is recessed with respect to the exterior surface of the walls. Thus, when the latches are in the latched or unlatched position, the latches do not project outwardly beyond the exterior surface of the walls.

Further, according to another object of the invention, the container has side and end walls that are movable between a first position in which the side and end walls are collapsed in the interior of the base and a second position in which the side and end walls are erect for being engaged at the corners by the latches. In the first position, the containers can be stacked at least two high to provide nested stacks of the containers for return shipment and storage of unused containers.

According to another object of the invention, the corners of an assembled container can be unlatched at one side of the container to enable a side wall thereof to be completely removed from the base to enable full access of the contents of the container for easy removal of the contents.

In particular, a preferred embodiment of the container of the invention has a base, first and second opposed side walls and opposed end walls. The first side wall is removably hinged to the base along a side of the base, and the second side wall is hinged with a hinge joint to an opposite side of the base. The end walls are hinged with hinge joints to the other sides of the base. Since the first side wall of the container is intended to be completely removed from the base, in a return shipment or unused position of the container, the first side wall can be laid down flat into the interior of the base with the second side wall on top of it. Then, the end walls can be rotated about their respective hinge joints to a position to lay down flat on top of the side walls in the interior of the base. In this first described position of the base and walls, a plurality of the containers can be stacked, with the stack of first and second side walls and end walls supporting the base of a next upper stacked container. In a second, erected position of the walls of the container, vertical edges of the first and second side walls are joined to vertical edges of the end walls, respectively, to form corner joints with over center corner latches.

According to another object of the present invention, each of the end walls has an inside corner having a mortise and tenon joint that receives a corresponding flange along an outer vertical edge of the side wall to hold the side wall in an erect position prior to latching the corner joints with the latches.

Preferably, the latches are over the center latches that are disposed in the recessed areas or pockets of the side walls adjacent the edges of the side walls. Each latch is constructed the same and has a pivoting latch bar that engages a corresponding recess on the end wall. Further, each latch preferably has an operating handle for operating the latch bar for changing a relative position of a pivot axis on which the pivoting latch bar pivots so that said pivot axis is positioned over center of a pivot axis of the operating handle to lock the latch bar in place in the latched position. The operating handle is rotated outwardly from the recessed area or pocket in which it is contained for disengaging the latch bar from the curved recess on the end wall.

BRIEF DESCRIPTION OF THE DRAWINGS

FIG. 23(*b*) is an enlarged view taken from encircled area 23(*b*) in FIG. 23(*a*).

DETAILED DESCRIPTION OF THE PREFERRED EMBODIMENTS

Figure 1:
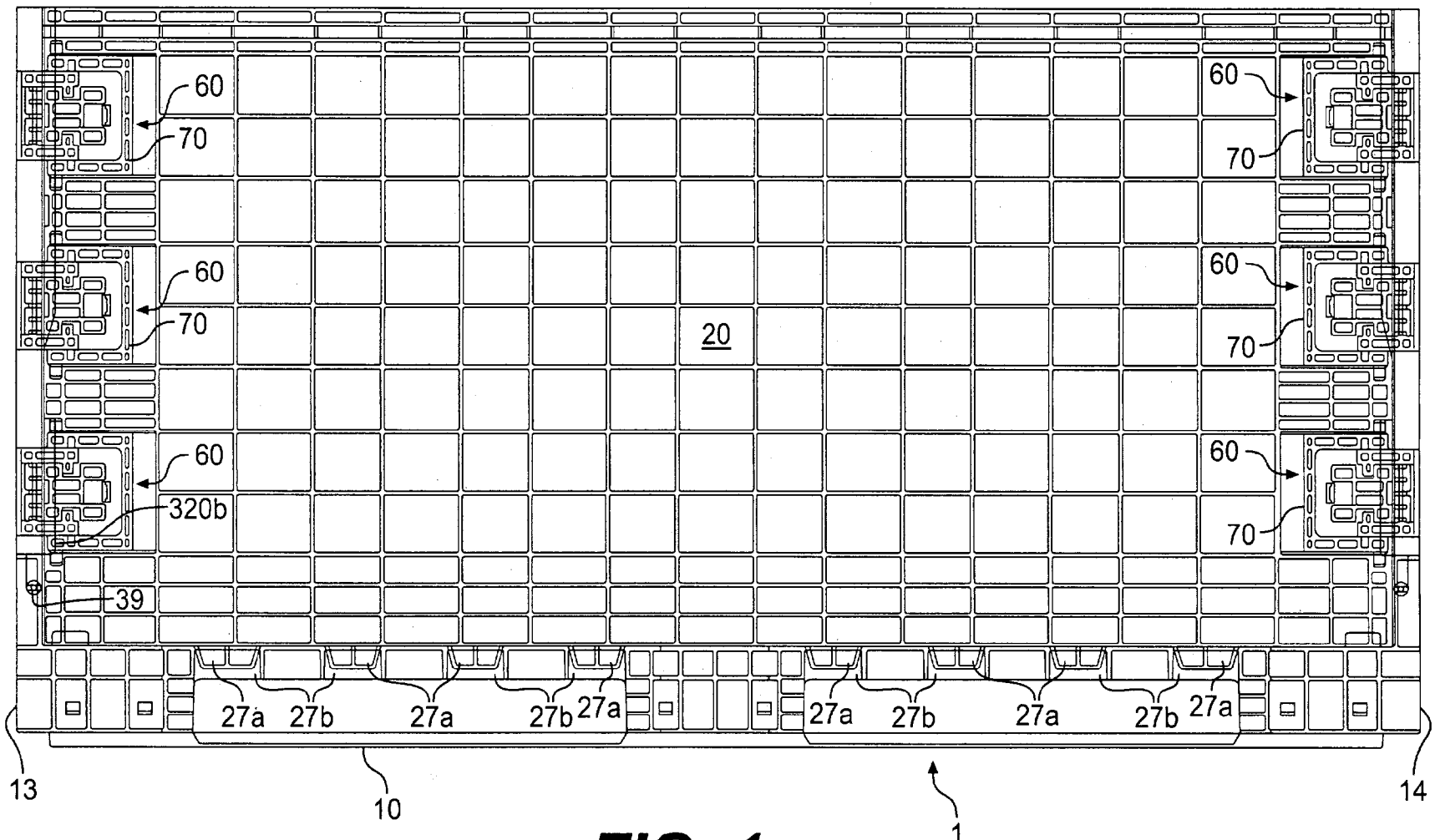
FIG. 1 is a side view of an assembled container shown with the side and end walls in an erected position and with a latch holding the walls together at the corners with over center latches.
Figure 2:
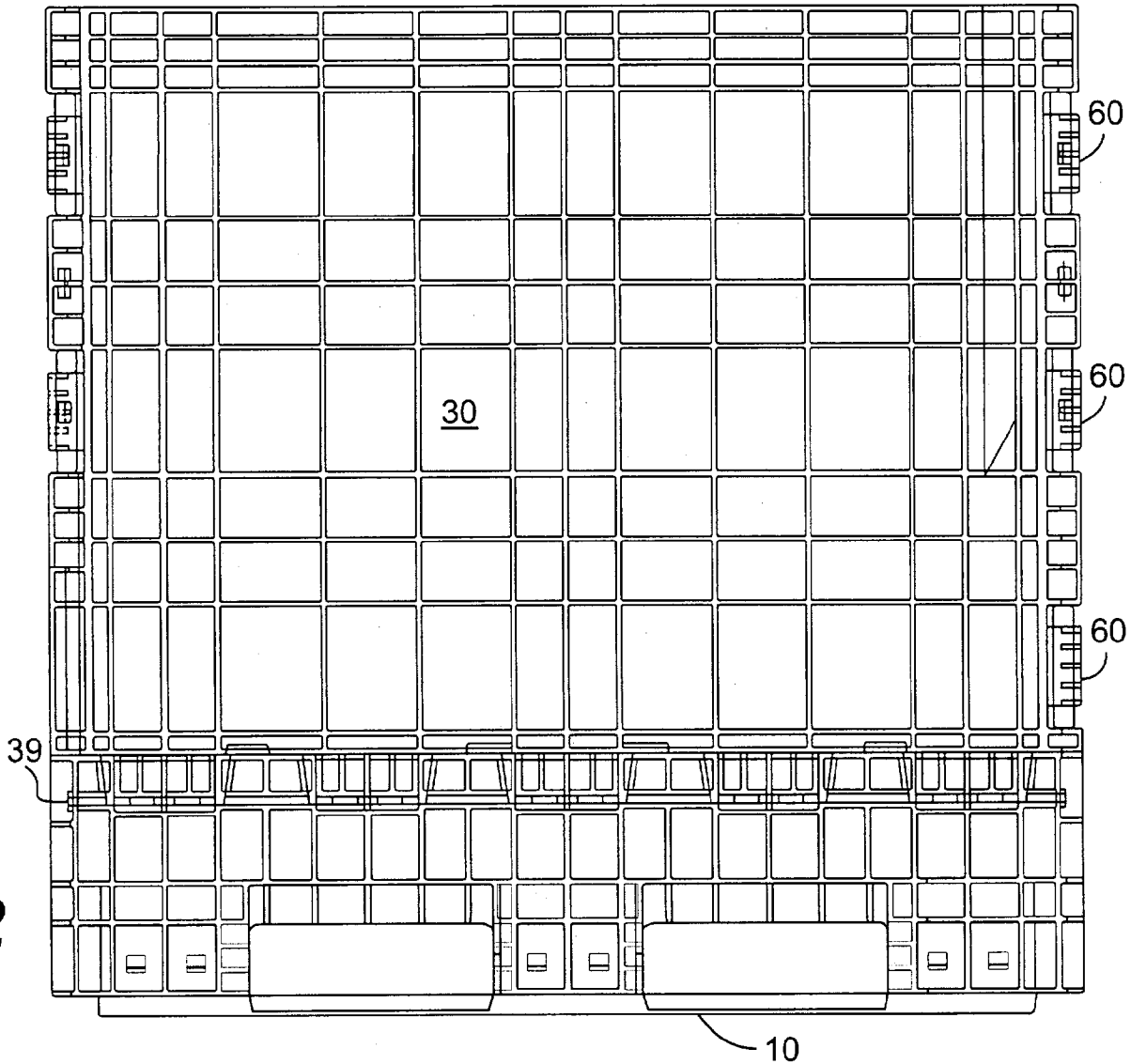
FIG. 2 is an end view of the assembled container shown in FIG. 1.
Figure 3:
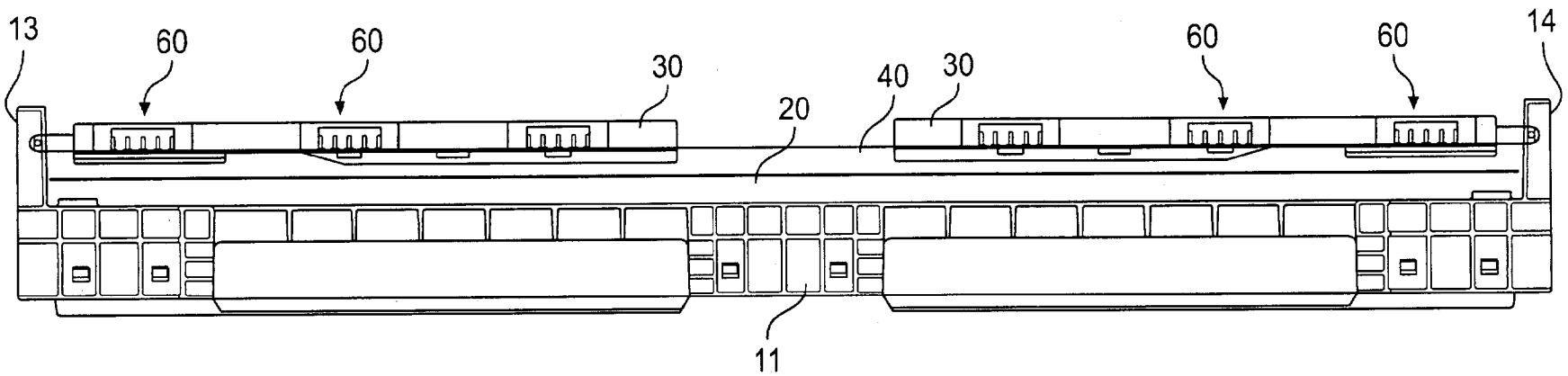
FIG. 3 is a side view of the container shown in FIG. 1 with one side wall disassembled and the other side wall and end walls pivoted into a flat, (nested) return shipment position.
Figure 4:
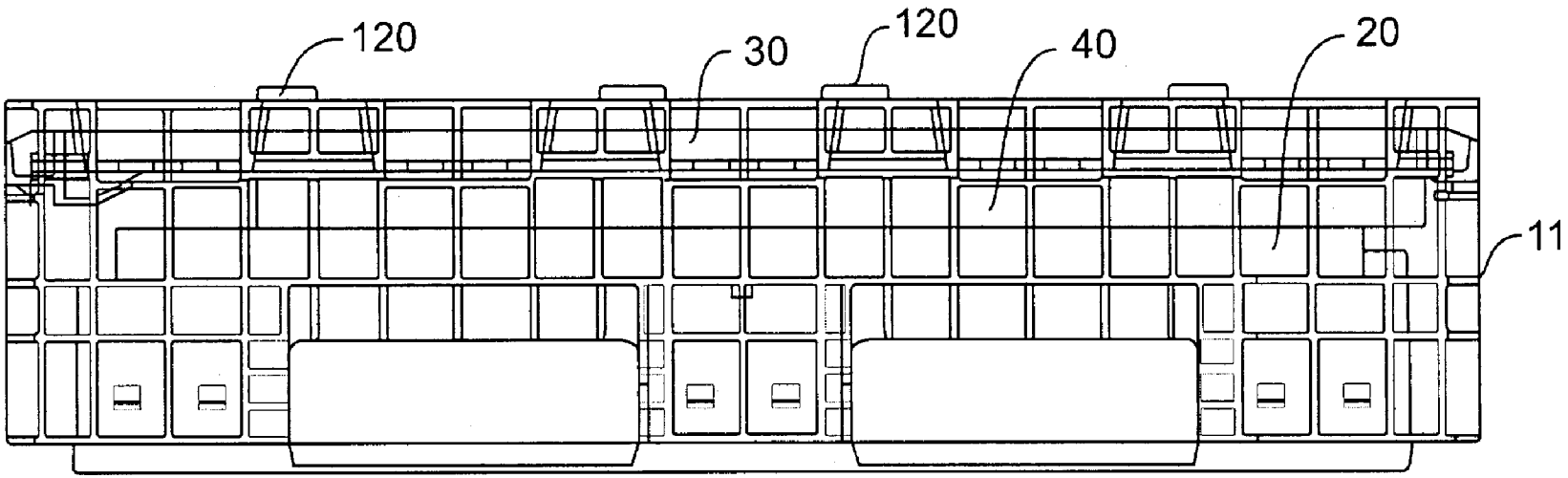
FIG. 4 is an end view of the container in the return shipment position shown in FIG. 2.
Figure 5:
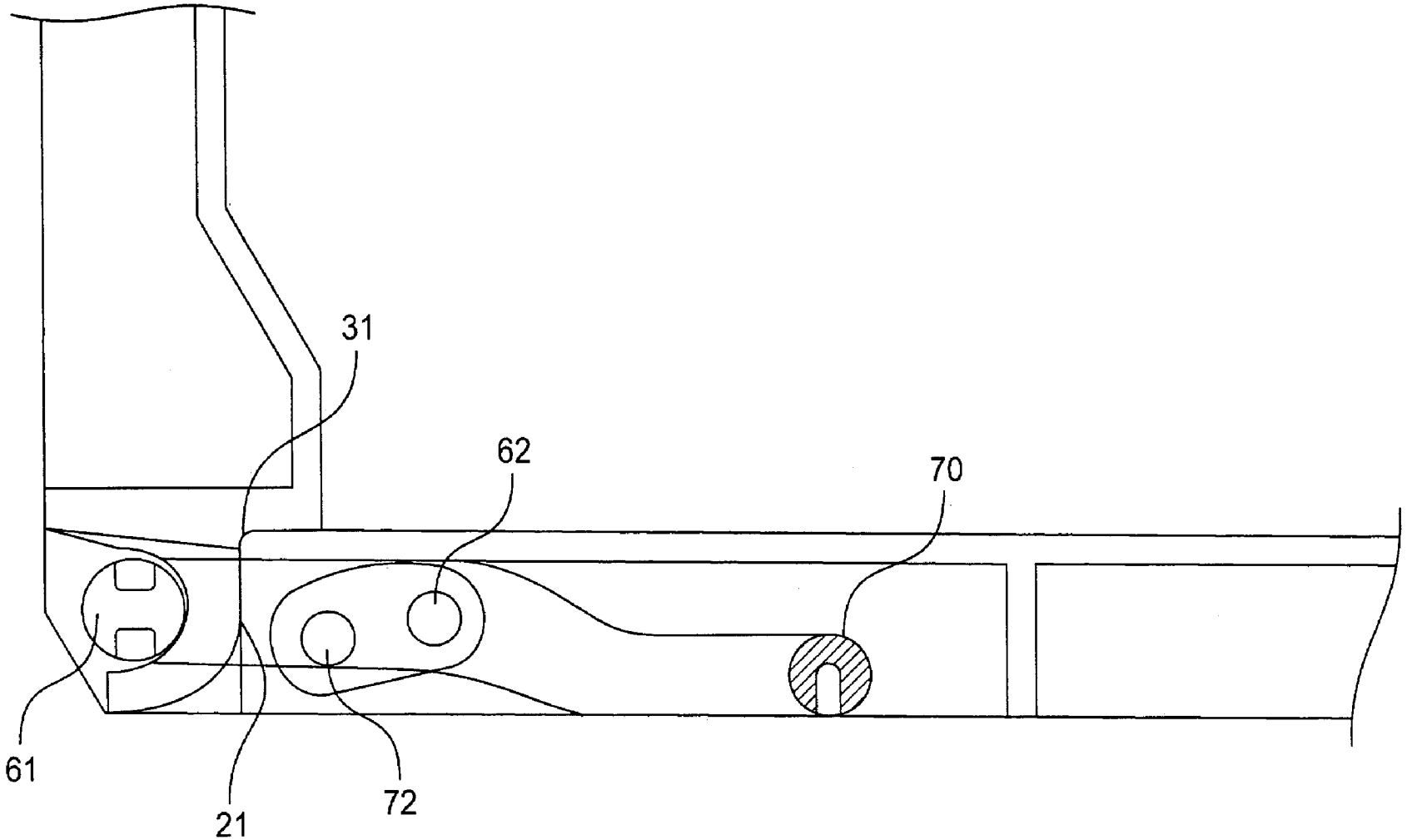
FIG. 5 is a sectional view of a latch shown with the corners latched together.
Figure 6:
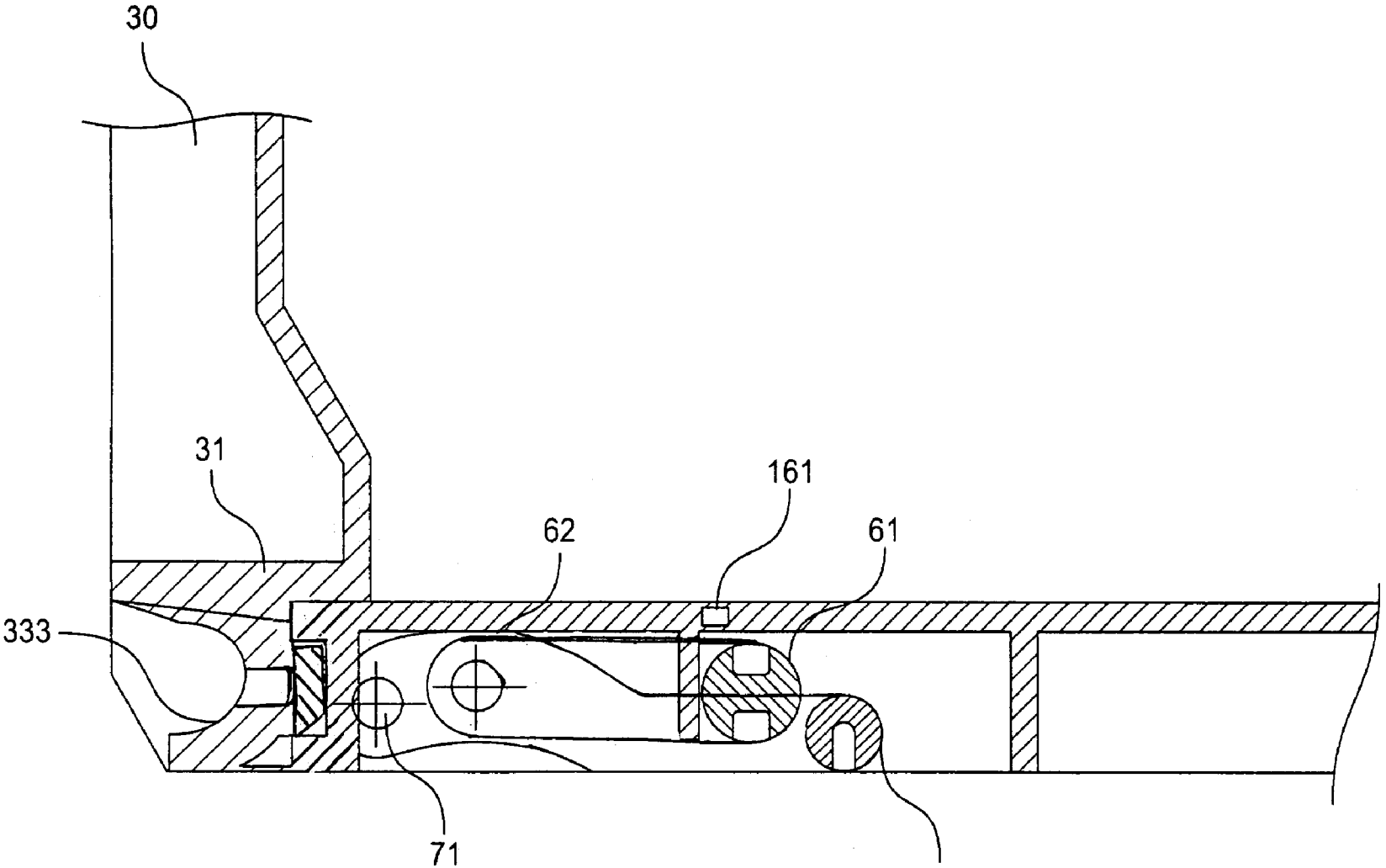
FIG. 6 is a sectional view of a corner latch shown with the latch bar of the latch rotated to a stored-away position.

FIG. 1 is a plan view of an assembled container 1, having a base 10, a side wall 20 (front side wall), another side wall (back side wall) 40, which is different from the front side wall, end walls 30 that are substantially the same (common features among the end walls are referred to by the same reference number), and latches 60 that connect the side and end walls together at the corners of the container. FIG. 2 shows that the side wall 20 has three latches 60, whereas the side wall 40 has only two latches 60. FIGS. 3 and 4 show the side wall 40 and end walls 30 pivoted downwardly to lay within the base along with side wall 20 in a return shipping position. FIGS. 5 and 6 show latches 60 joining the edges of the side walls 20, 40 to the edges of the end walls 30 to form the corners of the assembled container.

Figure 7:
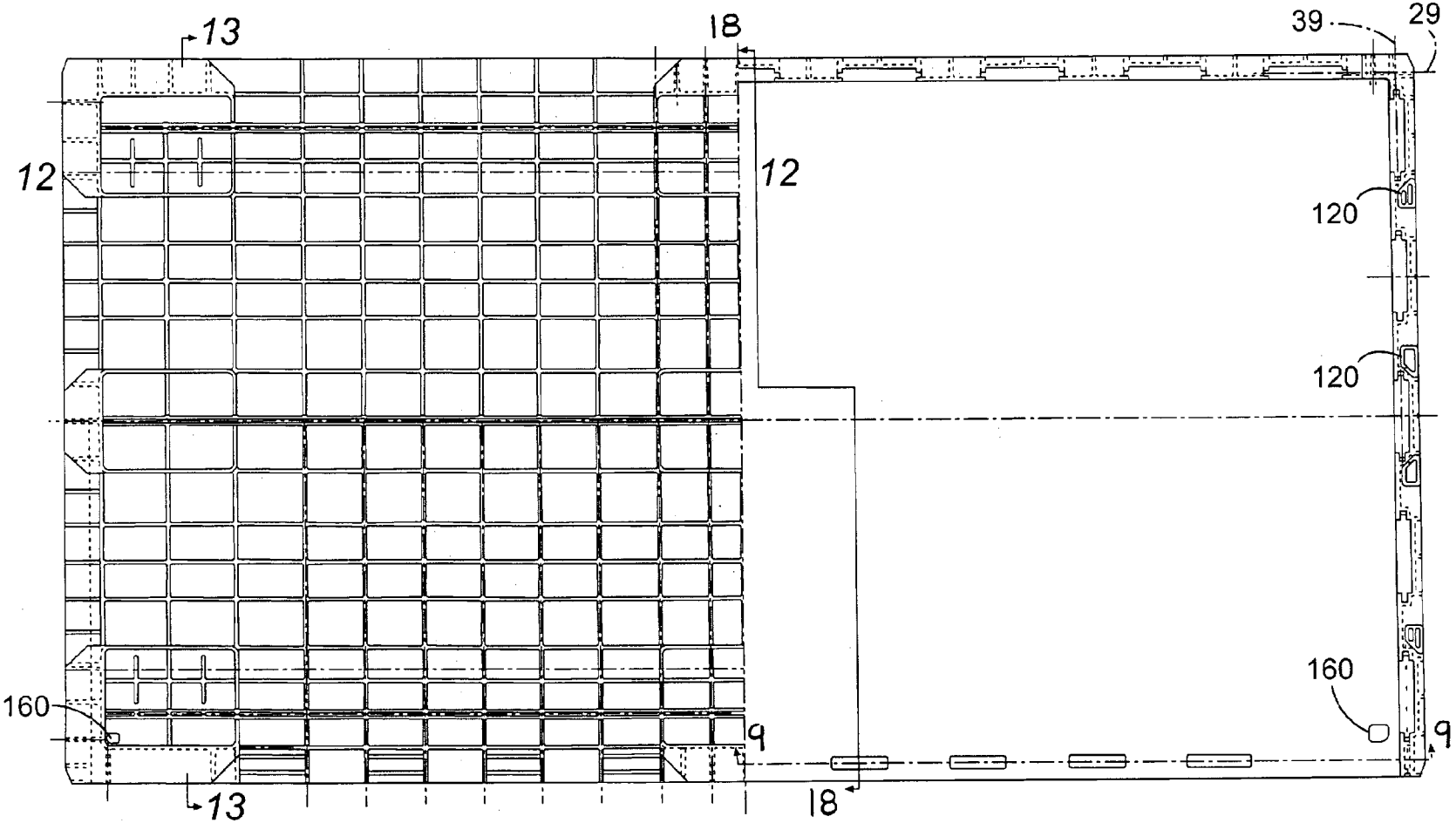
FIG. 7 is a top view of the base of the container shown in FIG. 1.
Figure 8:
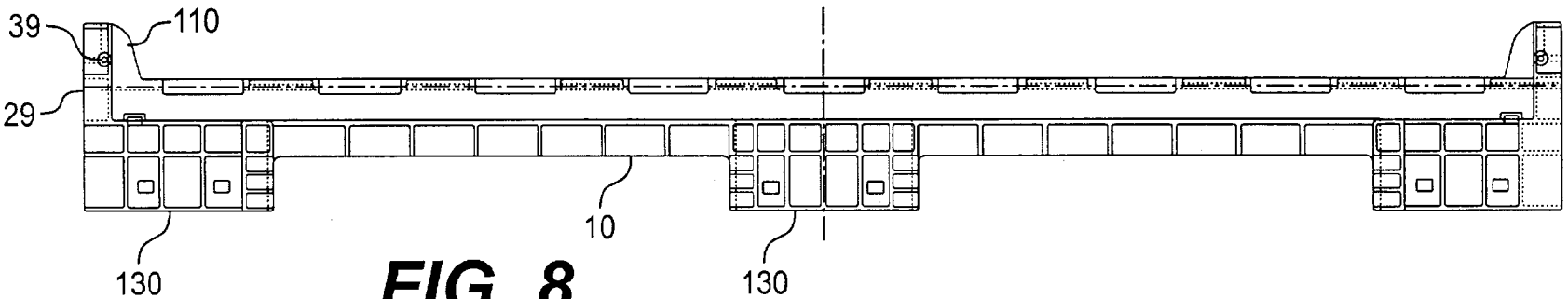
FIG. 8 is a side view of the base shown in FIG. 7.
Figure 9:
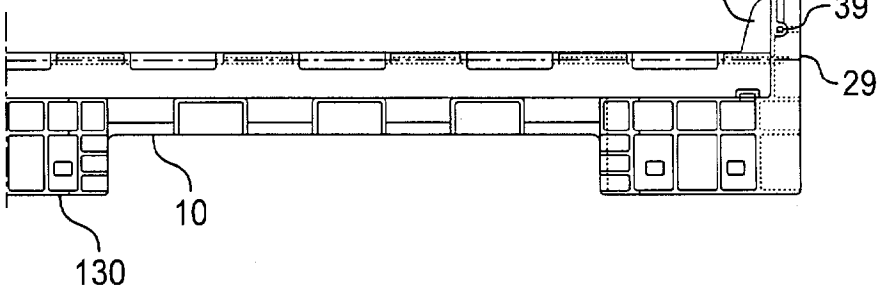
FIG. 9 is a partial sectional view taken from line 9—9 shown in FIG. 7.
Figure 10:
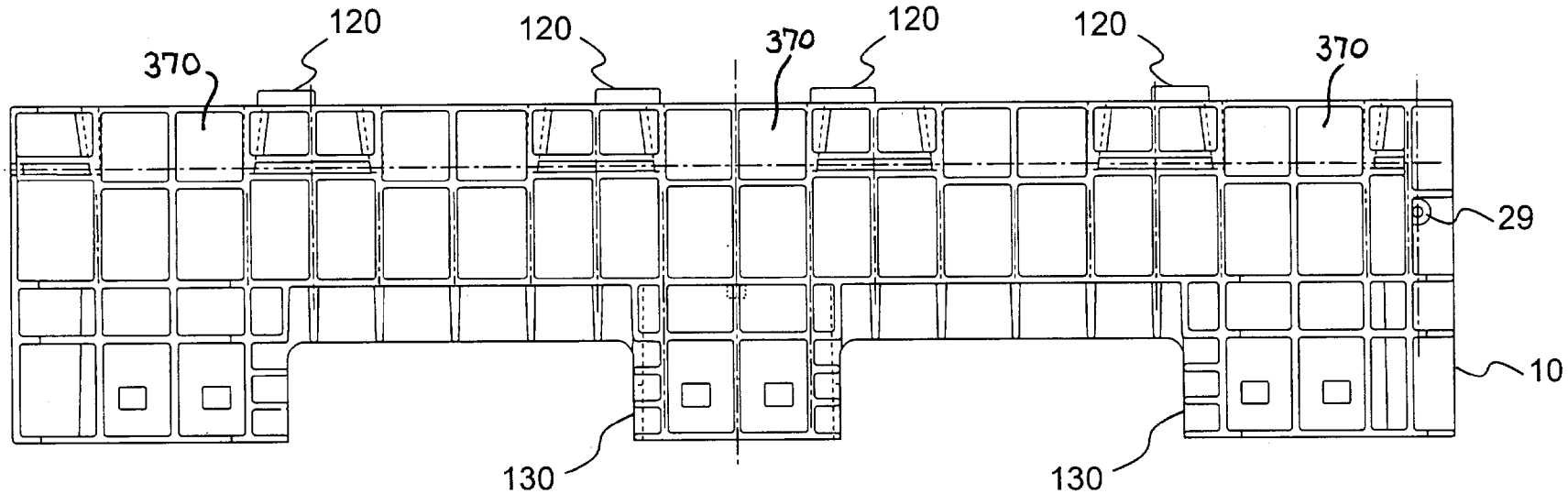
FIG. 10 is one end view of the base shown in FIG. 7.
Figure 11:
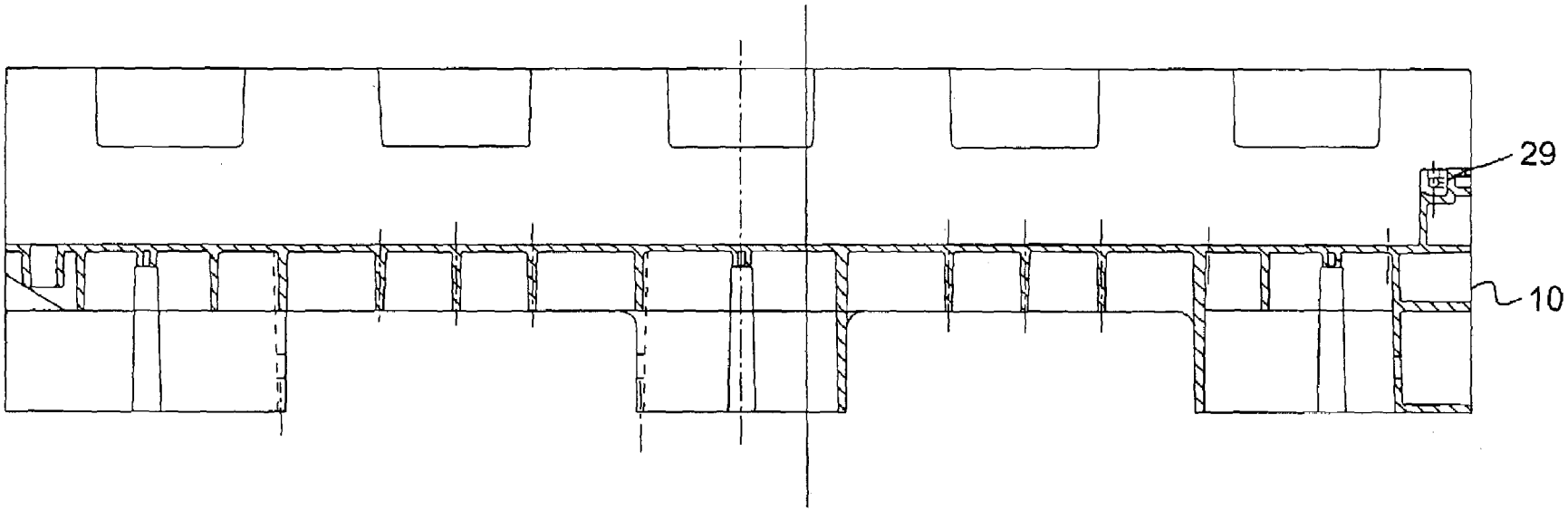
FIG. 11 is a sectional view taken along line 11—11 shown in FIG. 7.
Figure 12:
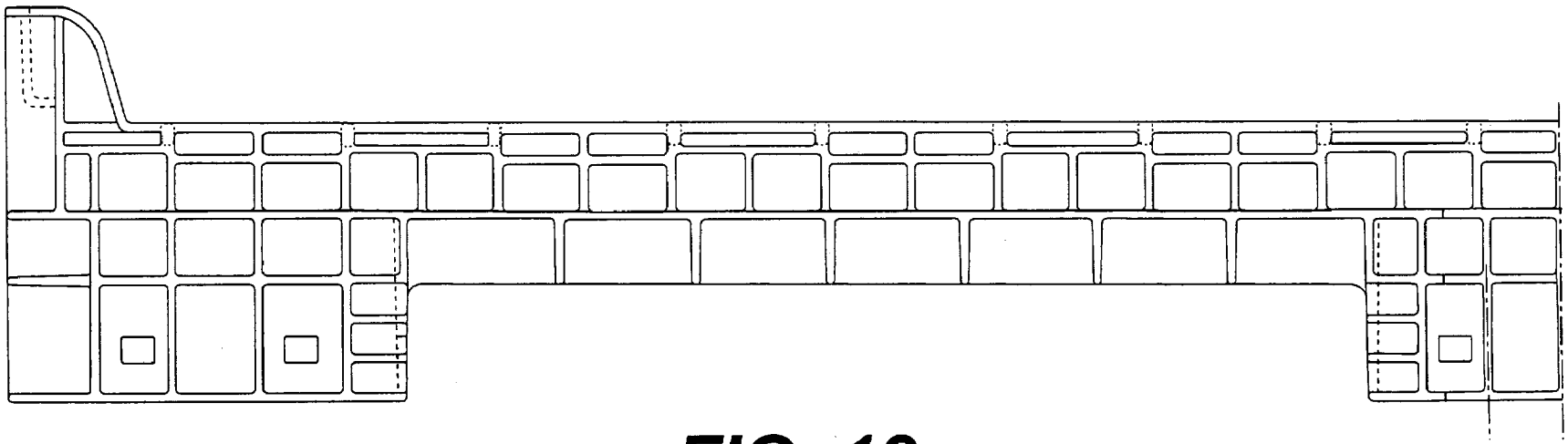
FIG. 12 is an opposite side view to that of FIG. 8 of one half of the base shown in FIG. 7.
Figure 13:
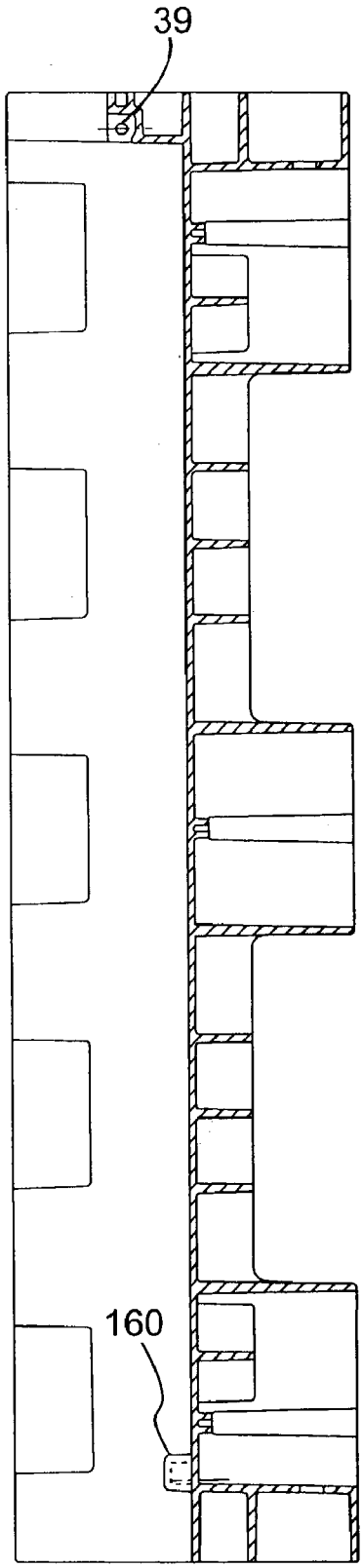
FIG. 13 is a sectional view taken along line 13—13 in FIG. 7.
Figure 14:
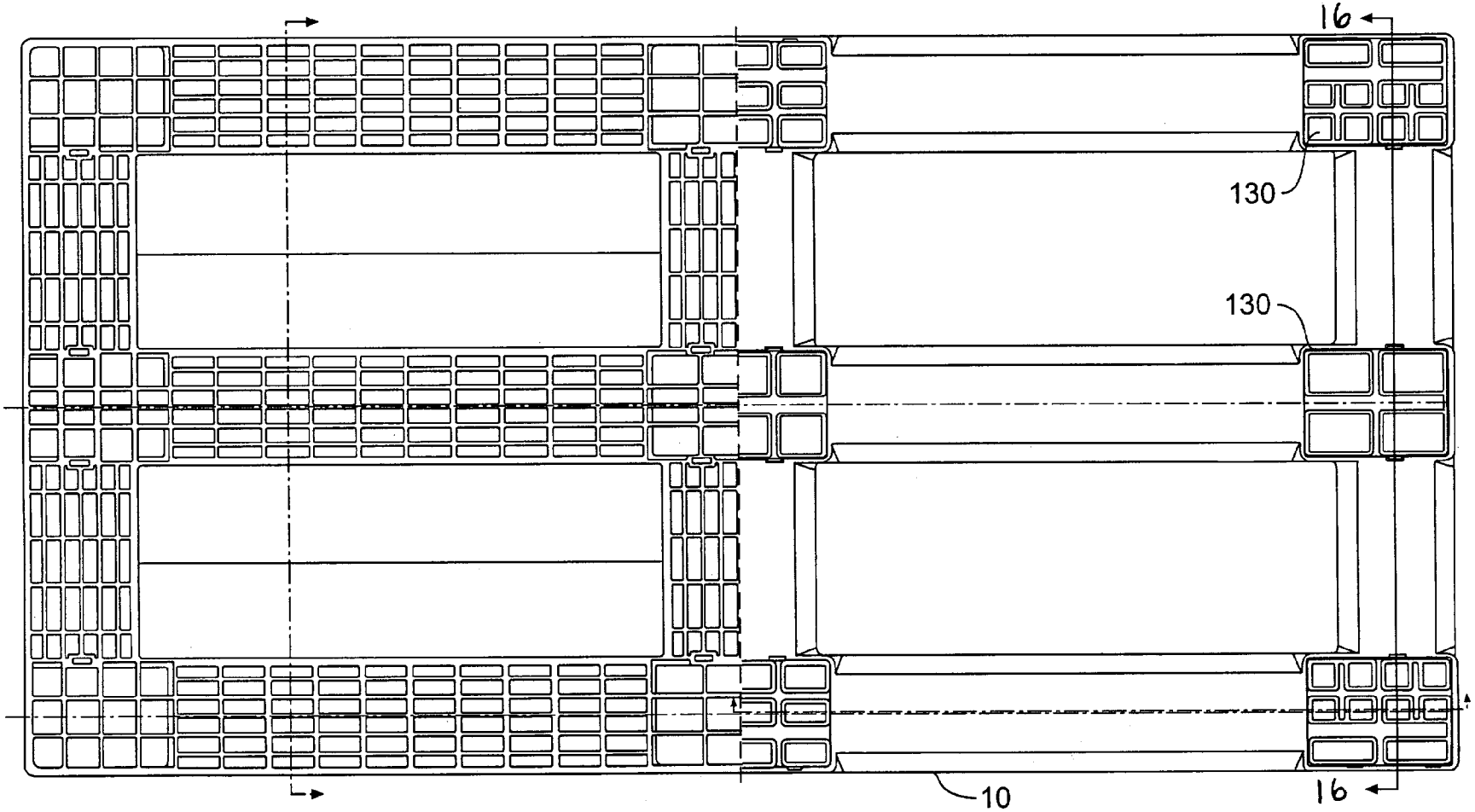
FIG. 14 is a bottom view of the base shown in FIG. 7.

Several views of base 10 are shown in FIGS. 7–19. In particular, FIG. 7 is a top view of the base shown in FIG. 1. FIG. 8 is a side view of the base 10 and FIG. 12 is an opposite side view to that of FIG. 8 of one half of the base. Further, FIG. 9 is a partial sectional view of the base 10 taken from line 9—9 shown in FIG. 7 and FIG. 10 is an end view of base 10. A sectional view taken along line 11—11 in FIG. 7 is shown in FIG. 11, while FIG. 13 is a sectional view taken along line 13—13 in FIG. 7.

Figure 15:
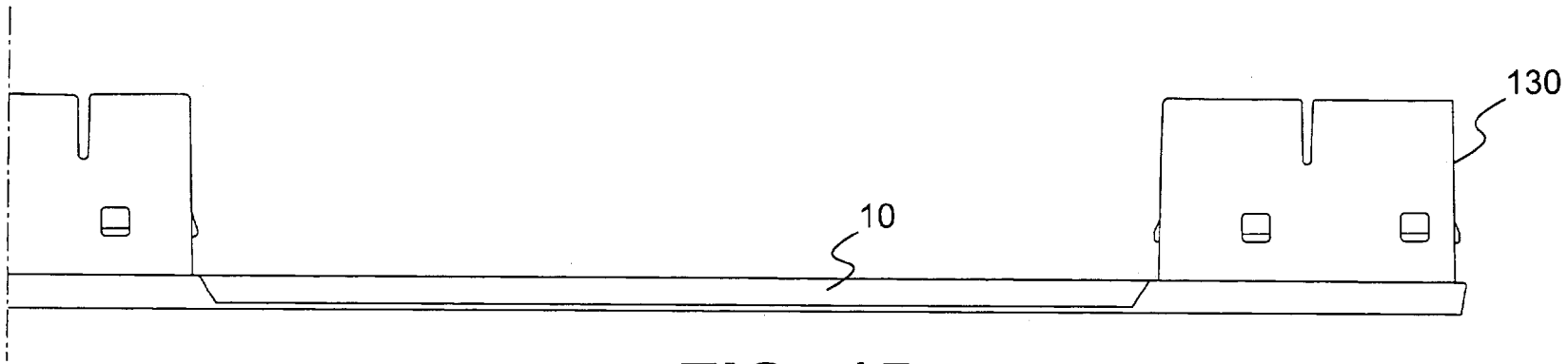
FIG. 15 is a partial side view of the base shown in FIG. 14.
Figure 16:
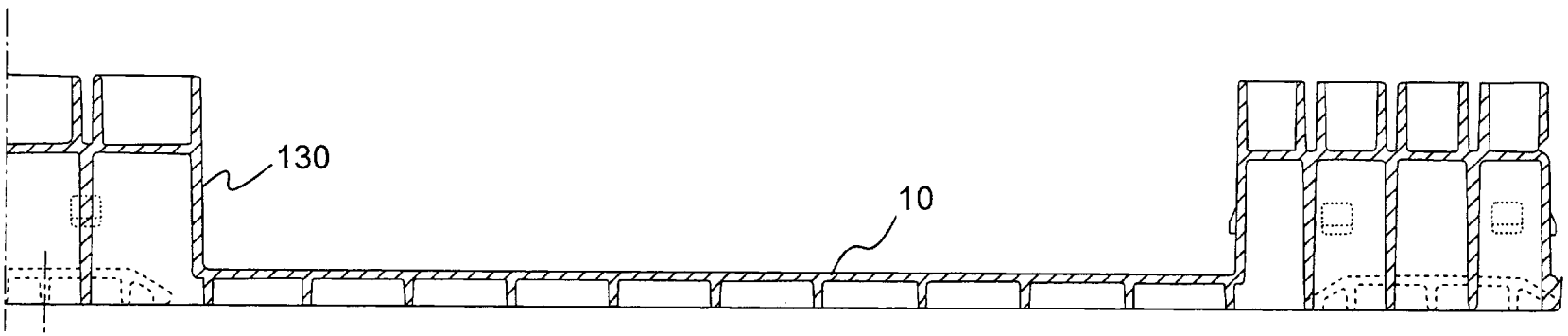
FIG. 16 is a partial sectional view taken along line 16—16 shown in FIG. 14.
Figure 17:
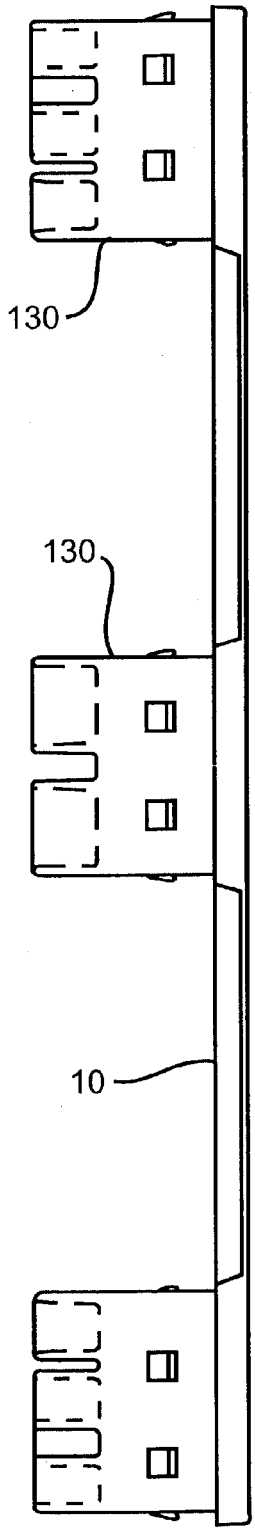
FIG. 17 is an end view of the base shown in FIG. 14.
Figure 18:
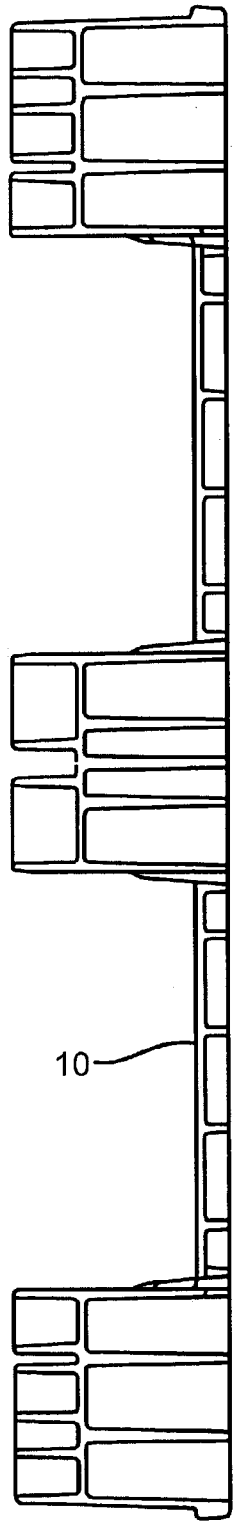
FIG. 18 is a partial sectional view of the base shown in FIG. 14 taken along line 18—18.
Figure 19:
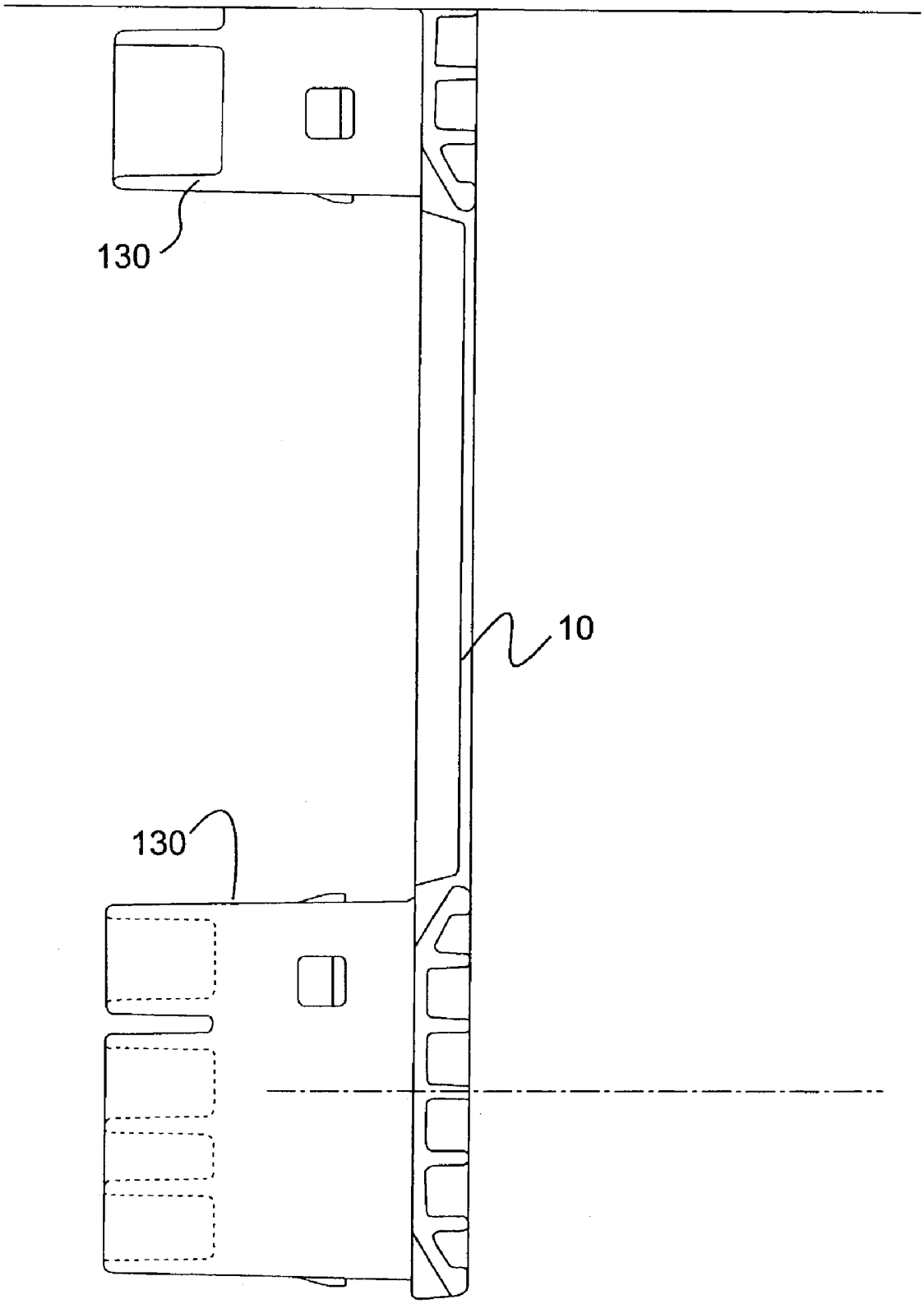
FIG. 19 is a partial end view of the base shown in FIG. 14 from the opposite side as compared with FIG. 17.

A bottom view of the base 10 is shown in FIGS. 14–19. In particular, FIG. 15 shows a partial side view of the base. FIG. 16 is a partial sectional view taken along line 16—16 shown in FIG. 14 while FIG. 17 is an end view of the base shown in FIG. 14. In FIG. 18, a partial sectional view of the base is shown that is taken along line 18—18 of FIG. 14. FIG. 19 is a partial end view of the base shown in FIG. 14 from the opposite side as compared with FIG. 17.

Figure 20:
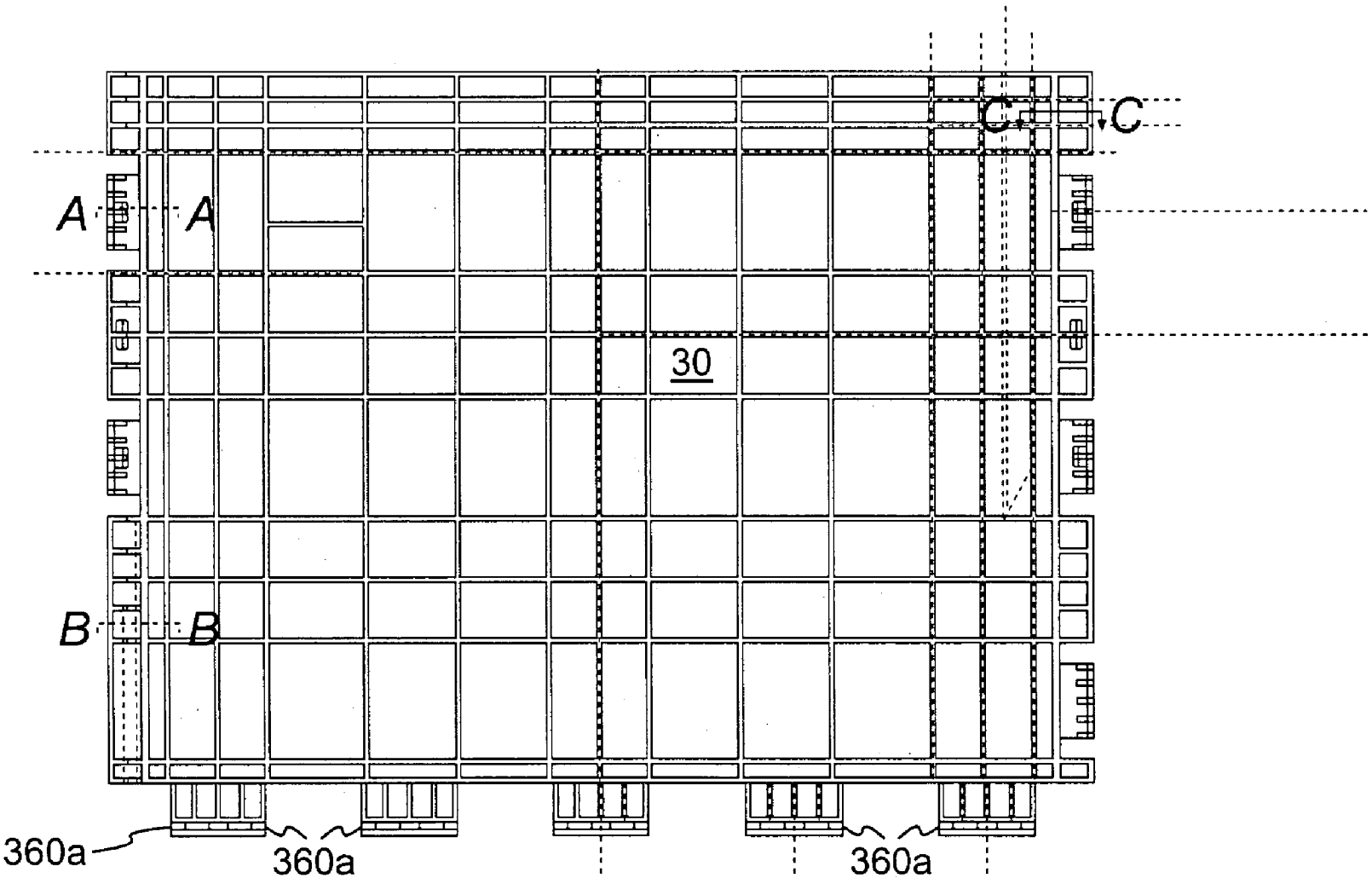
FIG. 20 is a plan view of an end wall of the container shown in FIG. 1.
Figure 21:
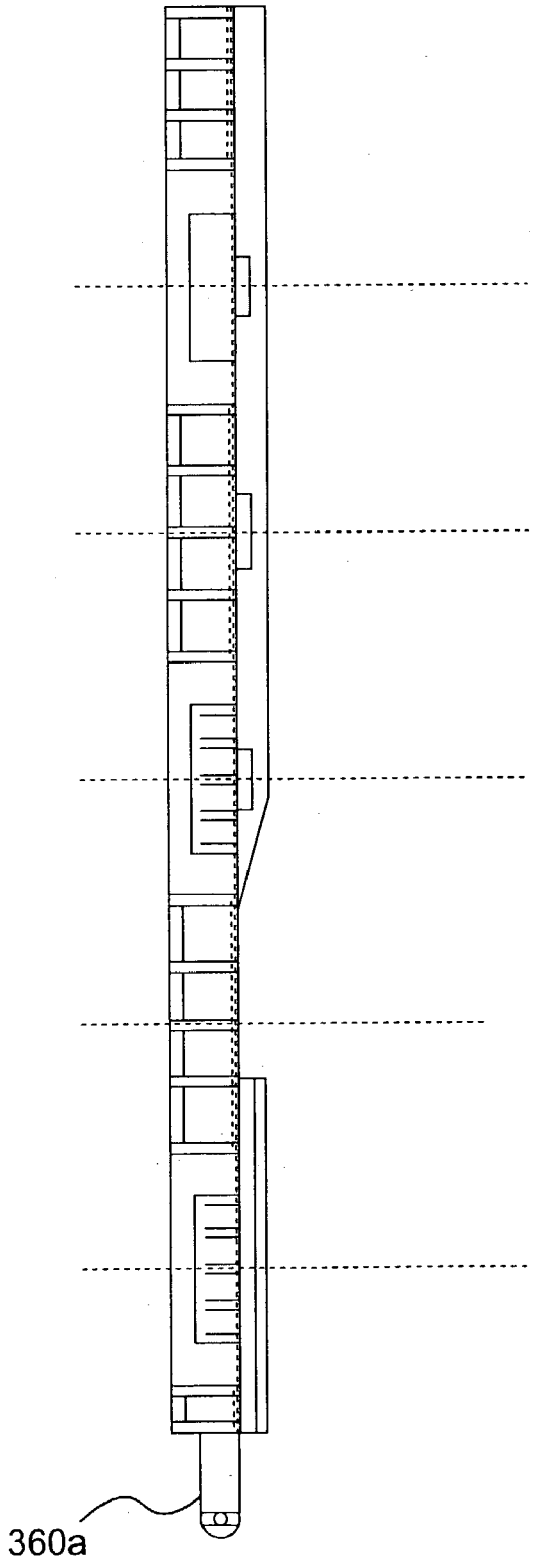
FIGS. 21 and 22 are side views of the end wall shown in FIG. 20.
Figure 22:
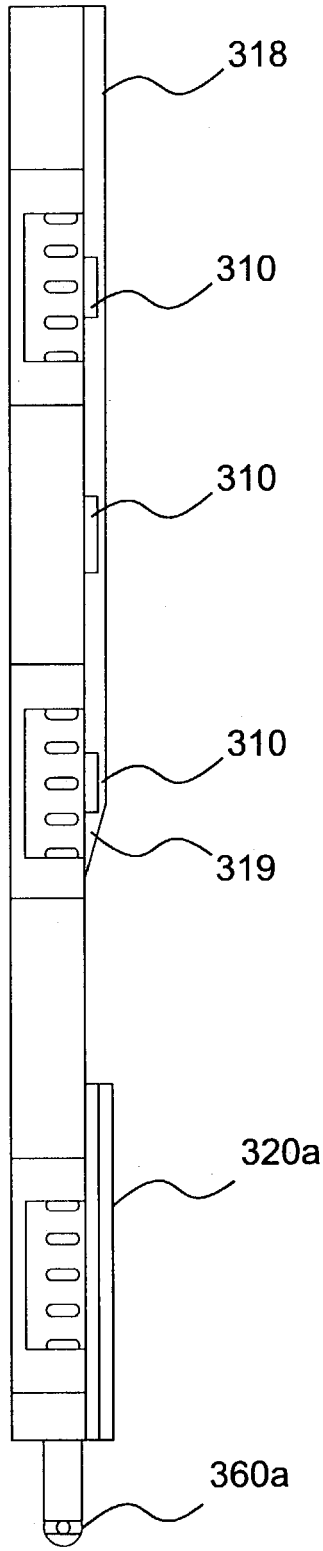
Figure 23A:
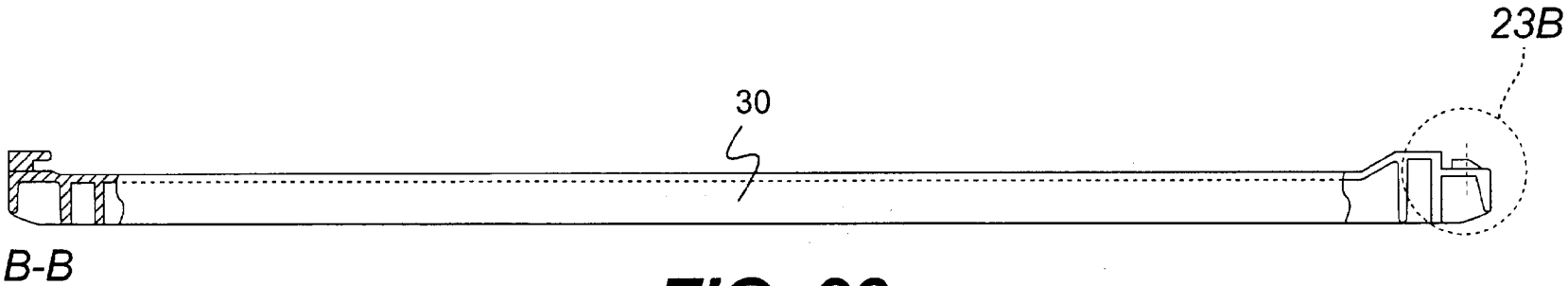
FIG. 23(*a*) is a top view of the end wall shown in FIG. 20.
Figure 23B:
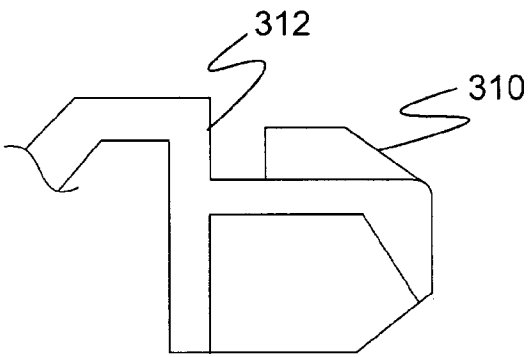
Figure 24:
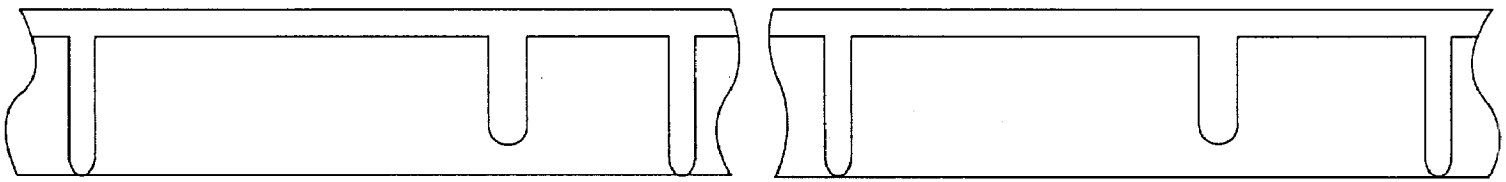
FIGS. 24 and 25 are partial side views of the end wall shown in FIG. 20 taken from the opposite side of the side views shown in FIGS. 21 and 22.
Figure 25:
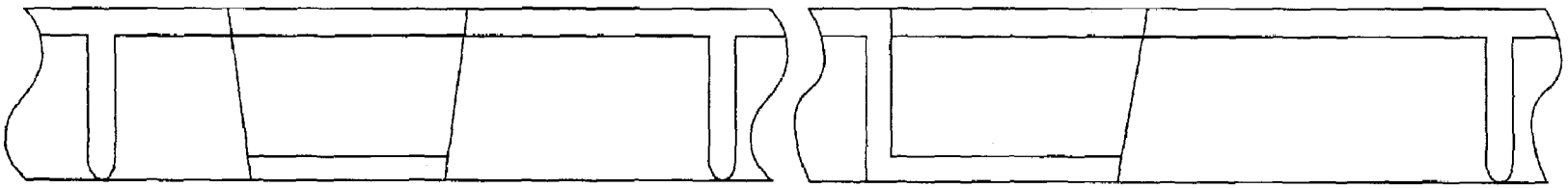
Figure 26:
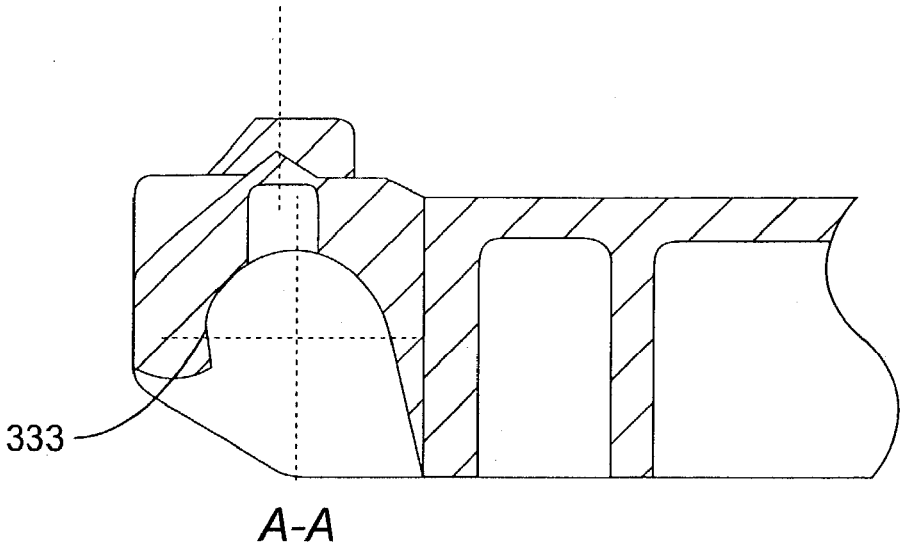
FIG. 26 is a partial sectional view taken along line A—A in FIG. 20.
Figure 27:
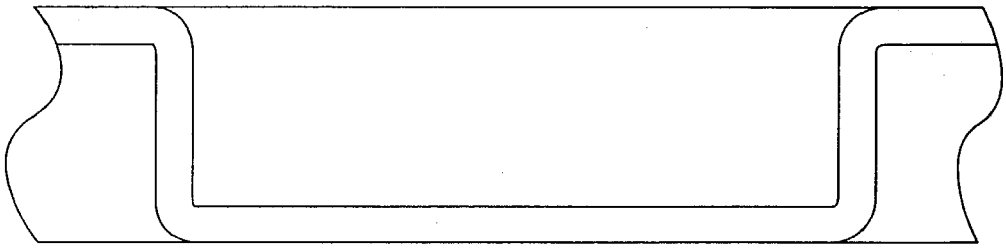
FIG. 27 is a partial sectional view taken along line C—C of FIG. 20.

FIGS. 20–27 show various views of the end wall 30 (both end walls are the same) of the container according to the invention. In particular, FIG. 20 is a plan view of an end wall 30 and FIGS. 21 and 22 are side views of the end wall. A top view of the end wall 30 is shown in FIG. 23(*a*) and an enlargement of a portion thereof is shown in FIG. 23(*b*). FIGS. 24 and 25 are partial side views of the end wall 30 taken from the opposite side of the views shown in FIGS. 21 and 22, respectively. Further, FIG. 26 is a partial sectional view taken along line A—A in FIG. 20 and FIG. 27 is a partial sectional view taken along line C—C of FIG. 20.

Figure 28:
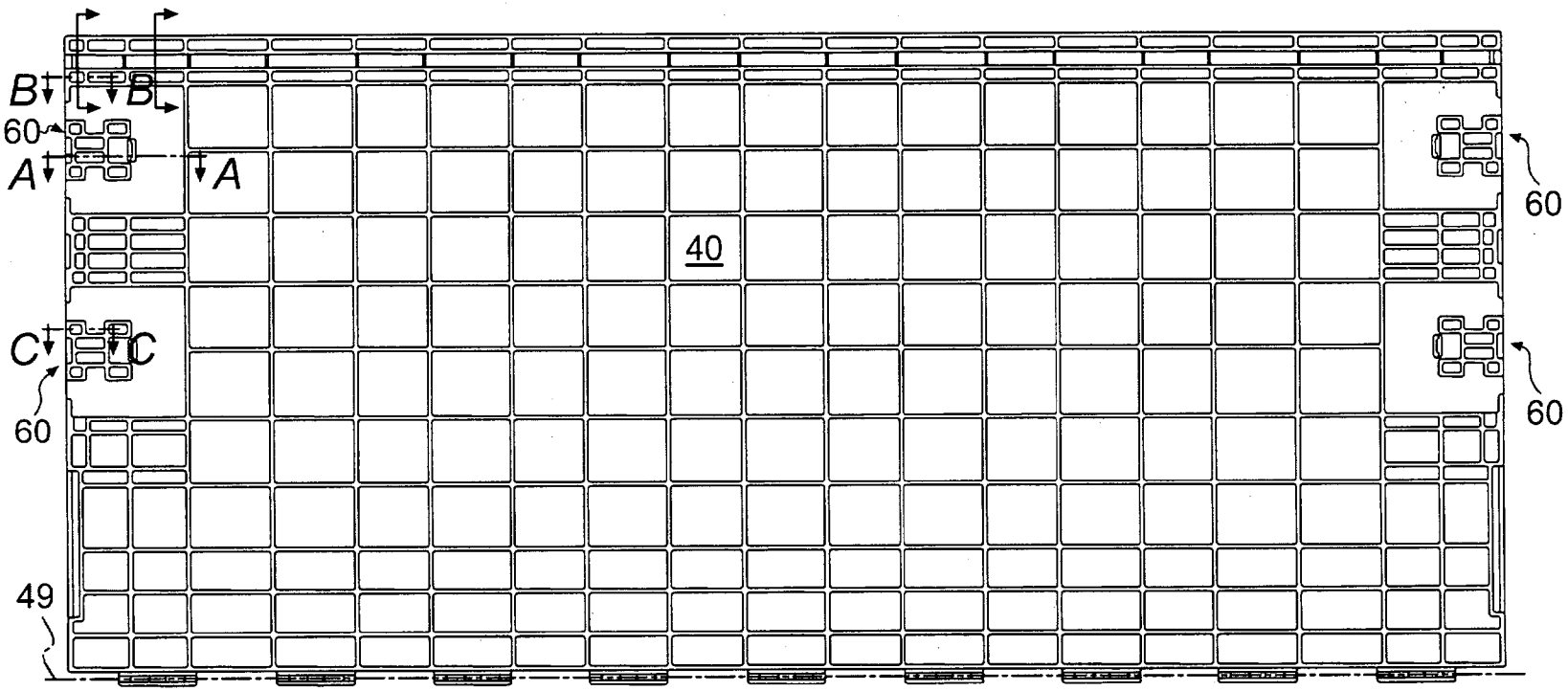
FIG. 28 is a plan view of the non-removable side wall of the container shown in FIG. 1.
Figure 29:
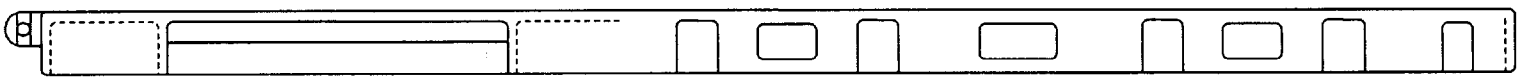
FIG. 29 is a side view of the side wall shown in FIG. 28.
Figure 31:
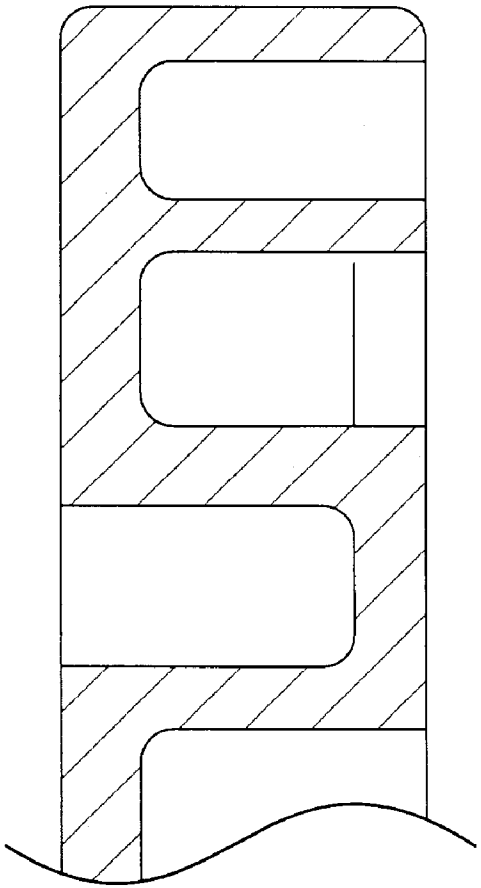
FIG. 31 is a partial sectional view taken along line 31—31 in FIG. 28.
Figure 30:
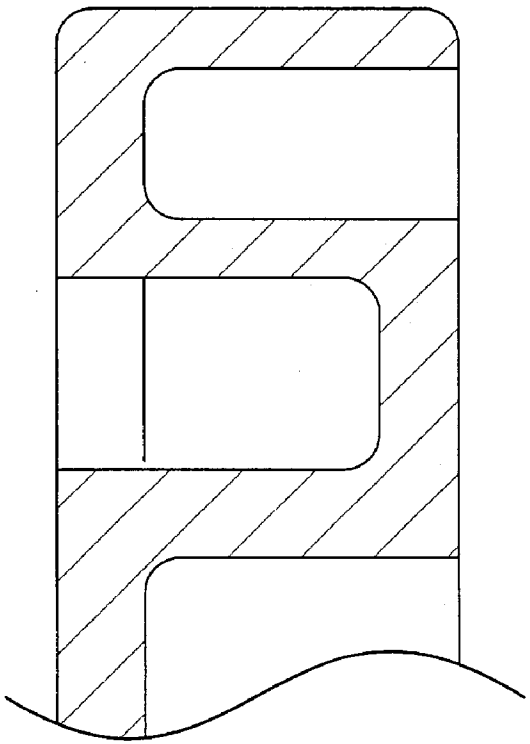
FIG. 30 is a partial sectional view taken along line 30—30 in FIG. 28.
Figure 32:
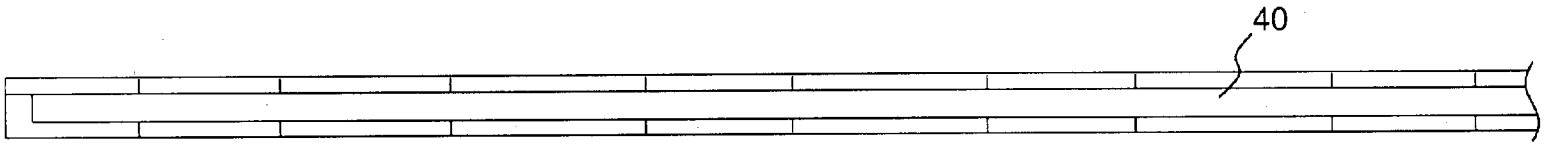
FIG. 32 is a partial top view of the side wall shown in FIG. 28.
Figure 33:
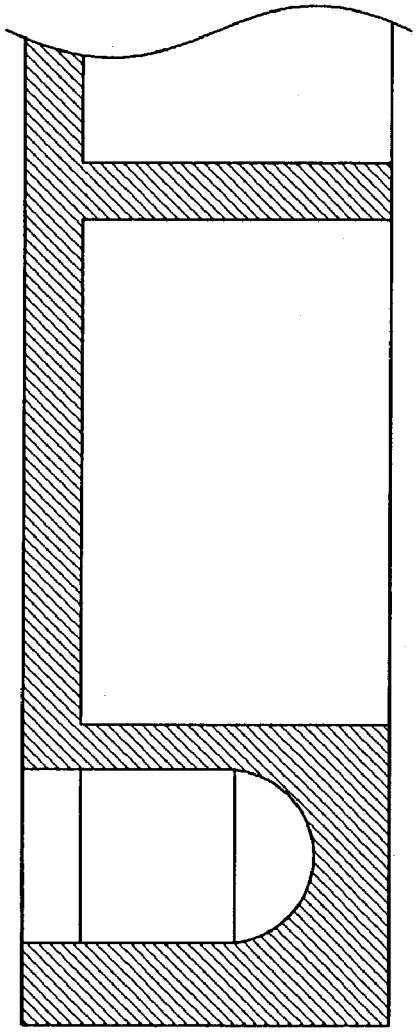
FIG. 33 is a partial section view of the section shown by lines B—B in FIG. 28.
Figure 34:
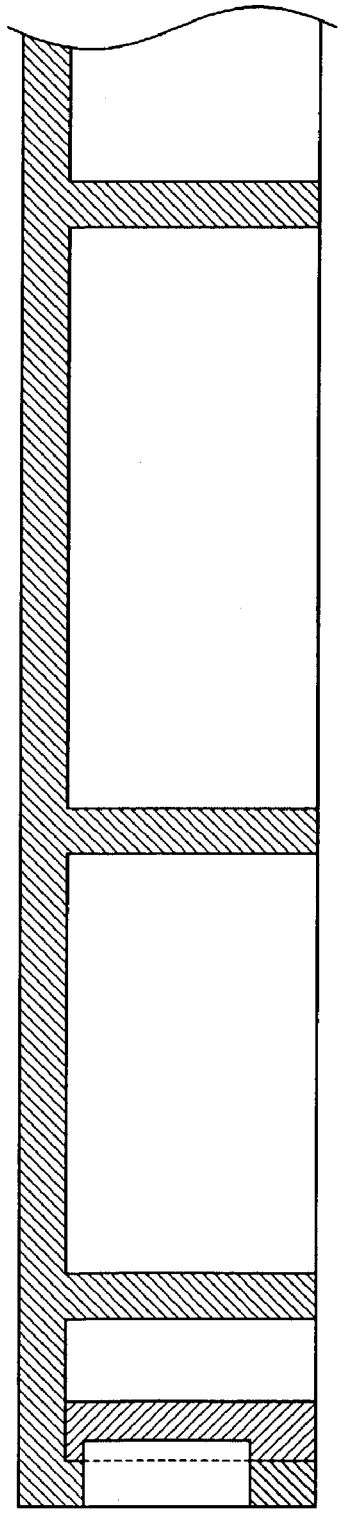
FIG. 34 is a partial sectional view of a portion of the side wall shown in FIG. 28.
Figure 35:
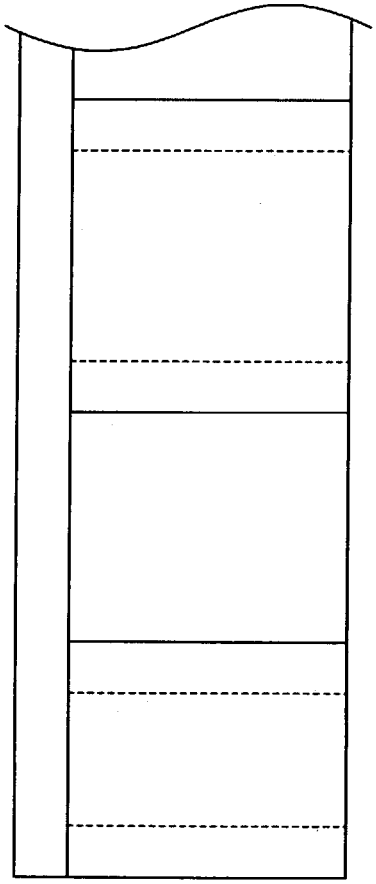
FIG. 35 is a sectional view taken along line C—C of FIG. 28.
Figure 36:
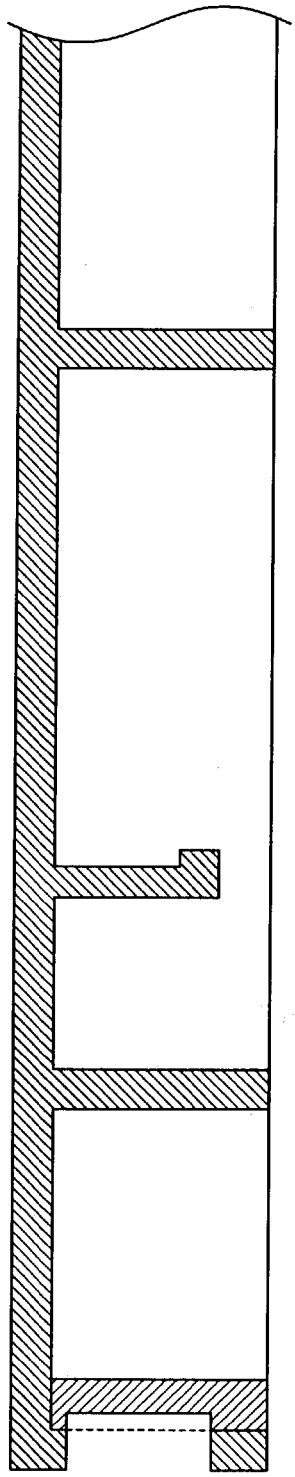
FIG. 36 is a partial sectional view taken along line A—A of FIG. 28.

FIGS. 28–36 are various views of the non-removable side wall 40 of the container. In particular, FIG. 28 is a plan view of the non-removable side wall and FIG. 29 is a side view thereof. FIG. 30 is a partial sectional view taken along line 30—30 in FIG. 28. FIG. 31 is a partial sectional view taken along line 31—31 in FIG. 28. FIG. 32 is a top view of the side wall and FIG. 33 is a partial sectional view of the section shown by lines B—B in FIG. 28. Further, FIG. 34 is a partial sectional view of a portion of the side wall and FIG. 35 is a sectional view taken along line C—C of FIG. 28, whereas FIG. 36 is a partial sectional view taken along line A—A of FIG. 28.

Figure 37:
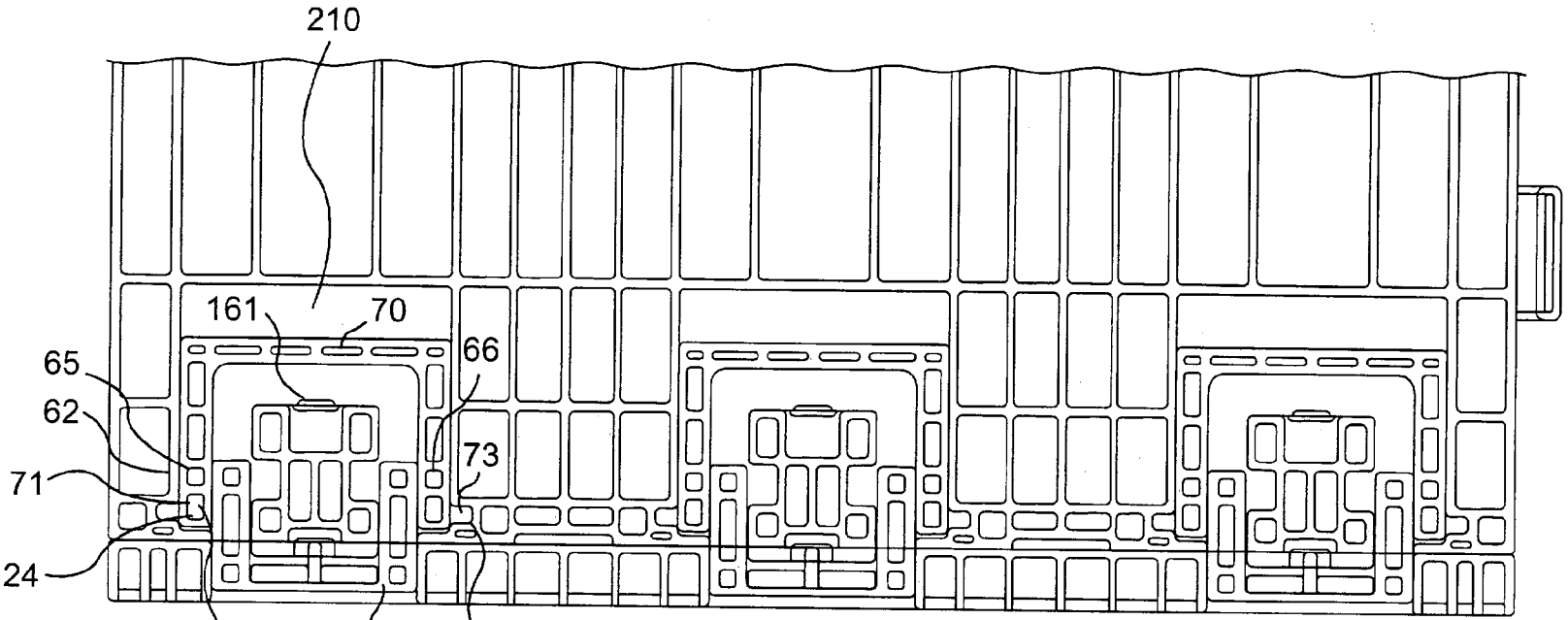
FIG. 37 is a partial plan view of the removable side wall of the container shown in FIG. 1.
Figure 38:
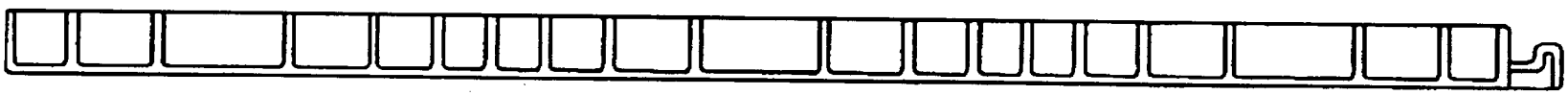
FIG. 38 is a top view of the side wall shown in FIG. 37.
Figure 39:
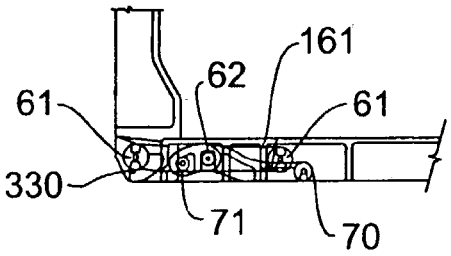
FIG. 39 is a partial sectional view of a corner joint shown in FIG. 1 showing the corner latch in detail.
Figure 40:
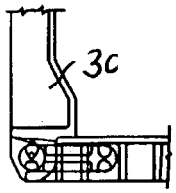
FIG. 40 is another partial sectional view of a corner joint shown in FIG. 1 showing the corner latch, in detail.
Figure 41:
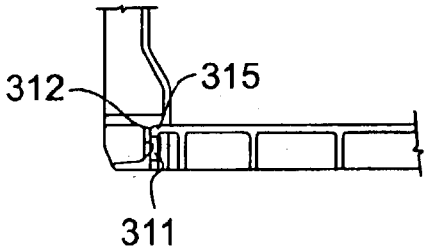
FIG. 41 is a top view of a corner joint shown in FIG. 1.
Figure 42:
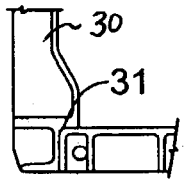
FIG. 42 is a top view of a corner joint shown in FIG. 1.
Figure 43:
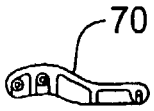
FIG. 43 is a plan view of the operator handle of the latch show in FIG. 39.
Figure 44:
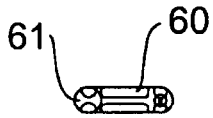
FIG. 44 is a plan view of the latch handle of the latch show in FIG. 39.

FIGS. 37–43 show the details of the corners of the container and the latches 60. In particular, FIG. 37 is a partial plan view of the removable side wall 20 and FIG. 38 is a top view thereof. FIG. 39 is a partial sectional view of a corner joint shown in FIG. 1 showing the corner latch 60 in detail. FIG. 40 is another partial sectional view of a corner joint showing the corner latch 60. Also, FIGS. 41 and 42 are top views of a corner joint. FIG. 43 is a plan view of the operator handle of the latch shown in FIG. 39 and FIG. 44 is a plan view of the latch handle of the latch 60 shown in FIG. 39.

In detail, FIGS. 1 and 2 show the container with the side and end walls in the assembled position. FIGS. 3 and 4 show the side and end walls in a return shipment or nonuse position in which the side wall 20 is removed and laid down flat in the interior of the base and side wall 40 and end walls 30 are pivoted downwardly about their respective hinge axes to overlay the side wall 20 within the base. The side wall 40 is hinged to the base 10 (see the hinge joint having axis 29, FIGS. 9 and 10) along side 12 of the base and the side wall 20 is a removable wall panel that is fixed in place along side 11 of the base when the container is assembled. Side wall 20 is completely removable from the base 10 and lays down flat in the interior of the base. Further, the side wall 20 can be removed and placed in the base while the other three walls are standing erect, for worker safety. Bosses in the base enable the panel 20 to remain in a position without sliding on the bottom of the inside of the base.

As shown in FIGS. 5 and 6, the latches 60 join the edges of the side walls 20, 40 to the edges of the end walls 30 to form the corners of the assembled container. The two end walls 30, which are hinged or pivot mounted along respective hinge axes 39 are erected first, then back side wall 40 is erected and latched with two latches 60, for example, to the end walls 30. Next, completely removable or detachable side wall 20 is lifted out from the interior of the base and staked into the side 11 of the base with angled flanges 27*a* that are received in holes 27*b* in the base (FIG. 1). The side wall 20 is then pushed into place to be latched at the corners with three latches 60 at each corner. End panels 30 have downwardly extending flanges 360*a* (FIG. 20) that terminate in the hinge joint in pockets 370 in the base (FIG. 10).

Specifically, at an inside corner 31 of each end wall 30 is a mortise and tenon type joint 310 having a ramped flange 311 (see FIGS. 23*a*, 23*b*) that receives a corresponding flange of a recess 315 (FIG. 41) along the outer vertical edge of the side wall 20 (at each of the left and right sides of the wall 20) that causes the edge of the recess to slide over the flange 311 and flex back into a position 312 (FIGS. 23*b* and 41) trapped behind flange 311 to hold the side wall in an erect position to assist in the assembly of the side wall with respect to forming the corner and latching the side wall to the end wall. This feature 310 on the end panels 30 is provided in three places as shown in FIGS. 21 and 22, for example. Also on each edge of the end panel, behind 310, is a flange 318 that extends from the top 34 of the end panel to ⅔ of the way down and terminating at an angled portion 319. At the bottom of the end panel is a protruding flange 320*a* (FIG. 22) that is received in a C flange 320*b* in the side wall to keep the corners in place (FIG. 22). The backing flange 318 does not extend the full way down the vertical edge of the end panels as shown in FIGS. 21 and 22 because the corner joints need to be flexed outwardly by bending the end panels to deflect them from the top down and sufficient deflection cannot be accomplished all the way down to the bottom of the end panel because of the hinged joint. Also, flanges 160 in the base that are projecting upward as shown in FIG. 3, for example, engage with the side wall 20 to enable the side wall panel to stay in place for assembly of the corner joints with the latches. The removable side wall 20 allows for easy and complete (end wall to end wall) access of the interior of the container.

When the corner joints of the container are unlatched, the panels or side and end walls 20, 30 are folded down into the base 10. The fold up sequence is important because the nested container with the end panels 30 on the top of the stack of panels is in full engagement with the back side wall 40 and the removable side wall 20 to provide weight distribution of the container stacked above it, as shown in FIG. 3. Nesting rails 110 (FIGS. 8 and 9) run across the ends of the base to which end panels are pivoted. Also the upstanding flanges 120 (FIG. 7) along the base capture the feet 130 of the base to prevent side to side shifting.

The assembly of the corner joints is shown in FIGS. 5, 6 and 39–42. The inside corner flange 31 abuts the outside corner 21 of the side wall 20. To hold the outside corner 21 of the side wall against the corner flange 31 of the end wall, the latch 60 has a latch bar 61 (FIG. 44) that engages a curved and structurally reinforced recess 330 (FIG. 39) on the end wall 30 that opens outwardly and is aligned to receive the pivoting latch bar 61 with clearance until the handle 70 (FIG. 43) is pulled back into the pocket 210 (FIG. 37), which changes the location of the pivot axis 62 (FIG. 39). Pivot axis 62 is comprised of a pair of outwardly protruding pins on a pair of spaced arms of the latch bar that are received in holes 65 and 66 in spaced arms of an operator or locking handle 70 of the latch assembly (FIG. 37). The arms of the latch bar are squeezed and the pins popped into the holes 65, 66 in the handle 70 only when the latch is in the open position. When the latch is in the locked position, the pins cannot be removed.

Handle 70 of the latch is an operating handle that is pivoted to move about an axis 71 through outwardly projecting pins 72, 73 on the arms of the handle that are received in holes 24, 25 in the side wall 20. The handle 70 can be squeezed so that the pins are popped into the recessed holes 24, 25 upon assembly of the latches. As shown, the latch bar 61 is received within a recess 330 and held in a position such that its pivot axis is over center of the pivot axis 71 for the operator handle as shown in FIGS. 5 and 39. In this position, the over center orientation of the pivot axis 62 keeps the operating handle 70 urged against the side wall to maintain the latched position of the latch. Further, in this position, the latch is entirely contained within the recessed area or pocket 210. To open the latch, the operating handle is pivoted outwardly from the side wall, thereby moving the pivot axis closer to the recess 333 and allowing the latch bar to be unseated from the recess.

Figure 45:
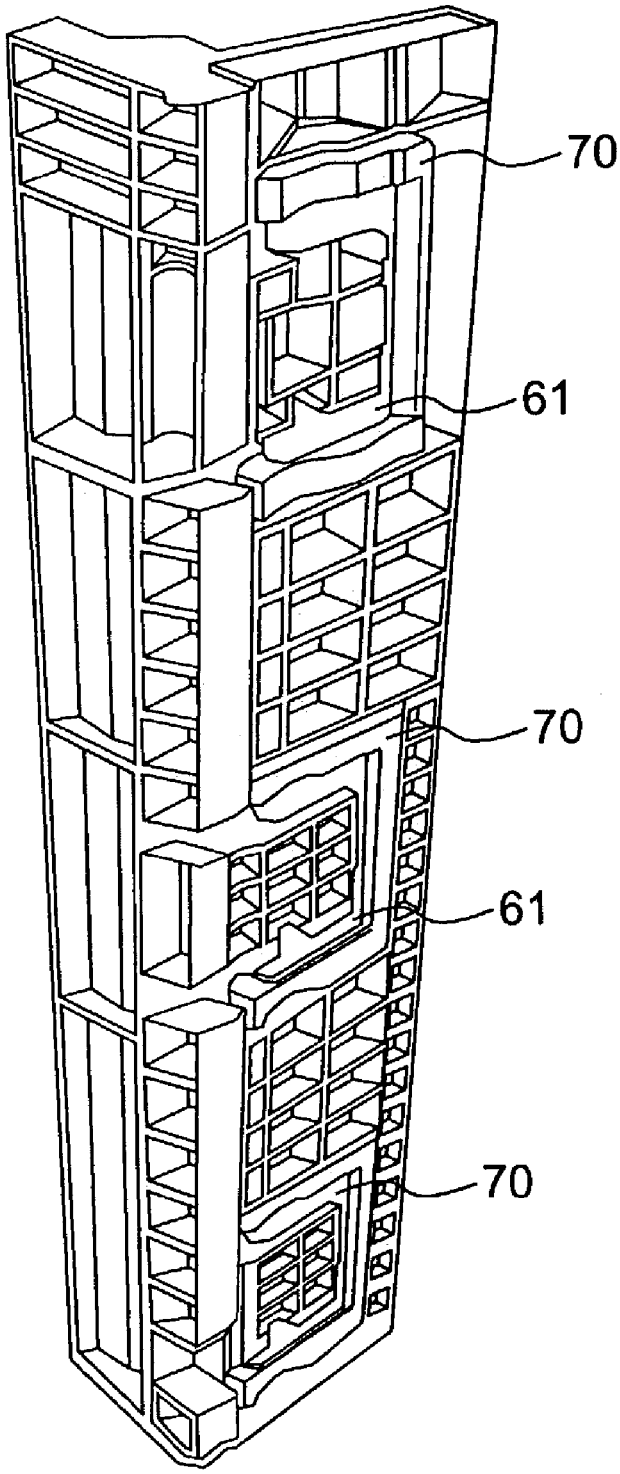
FIG. 45 is a partial perspective view of a corner joint shown in FIG. 1 showing the corner latch in detail in an unengaged position lying flat against the side wall.
Figure 46:
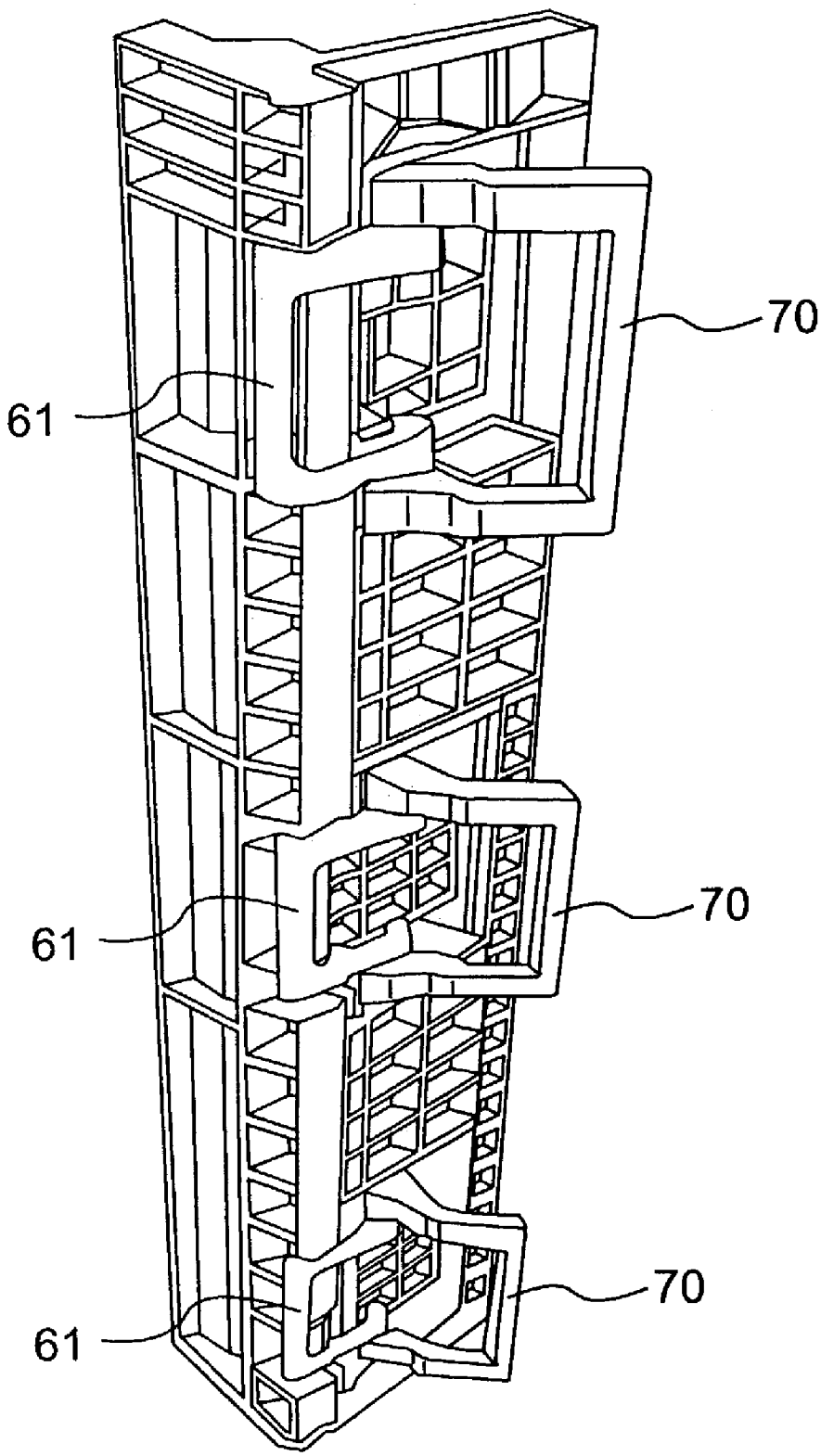
FIG. 46 is a partial perspective view of the corner joint shown in FIG. 45 showing the latch bar of the corner latch engaged with the end wall.
Figure 47:
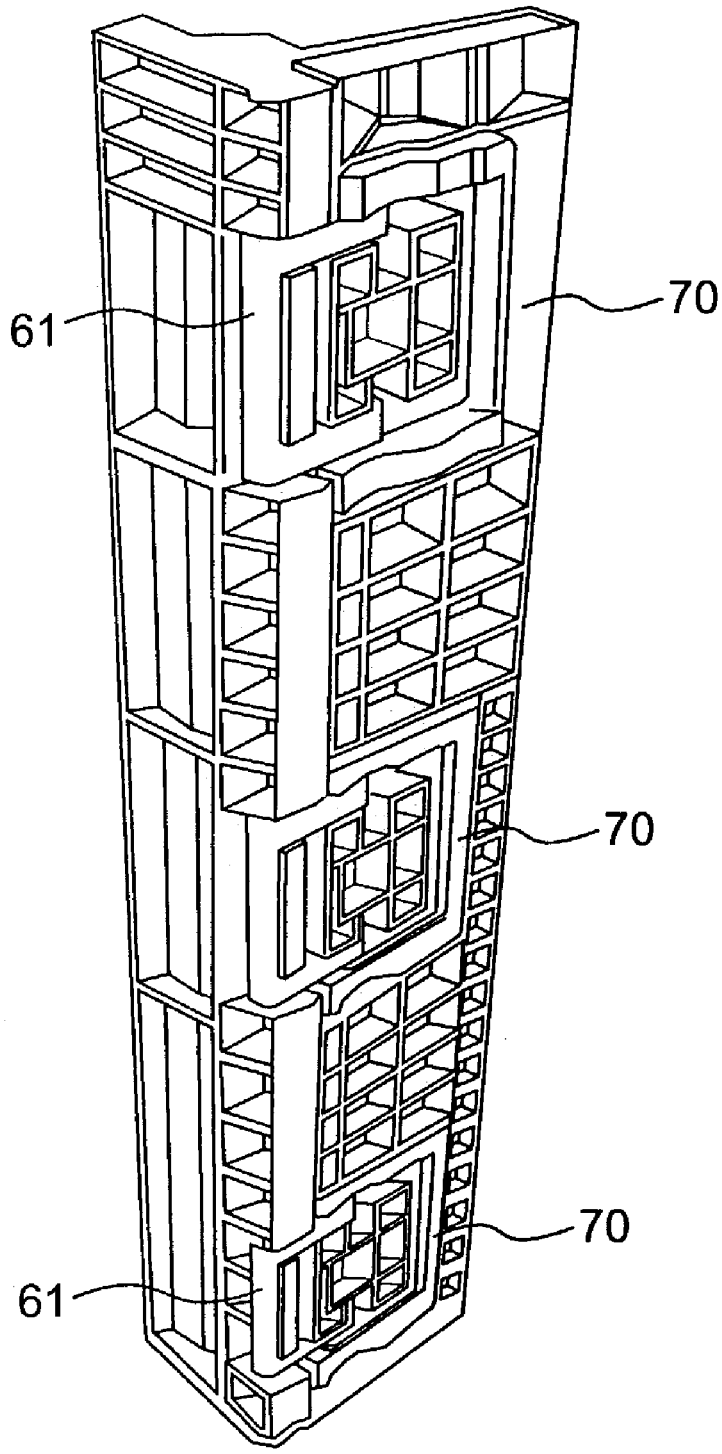
FIG. 47 is a partial perspective view of the corner joint shown in FIG. 45 showing the latch bar of the corner latch engaged with the end wall and the operator handle in the over center locked position.

As shown in FIG. 6, when the latch handle is disengaged, the latch handle and operator handle are stowed to a stored position in pocket 210 in order to lay flush with the exterior surface of the side wall. Further, in the disengaged position, the bar end 61 of the latch 60 is supported (snap fit) by a flange structure 161 in pocket 210. To disengage the latch bar 61 from engagement with the flange 161, the handle 70 is rotated outwardly, thus facilitating the beginning of the sequence for latching the edges of the panels together at the corners of the container. FIG. 45 shows the latches disengaged, FIG. 46 shows the latch bar 61 rotated around to the position in engagement with recess 333. FIG. 47 shows the handle 70 in the locked position, which secures the latch 60 in place and forms the corner joints for the container. All of the latches are of similar construction.

Preferably, the base is a two piece snap-together structure that is secured together by steel tubing that runs the length of the container. The container is preferably constructed of parts that are injection molded using a synthetic resin molding technique that includes molding the base, side walls and end walls, as well as the parts of the latches 60 of a synthetic resin material. The width of a preferred embodiment of the container is approximately 95". When the containers have their walls pivoted into the return shipment position, at least two of the containers can be stacked on one another during transportation and storage of the stacked containers.

While preferred embodiments have been set forth with specific details, further embodiments, modifications and variations are contemplated according to the broader aspects of the present invention, all as determined by the spirit and scope of the following claims.

The invention claimed is:

1. A container, comprising:

a base, first and second opposed side walls and opposed end walls;

said first side wall being removably hinged to the base along a side of the base, said second side wall being hinged with a hinge joint to an opposite side of the base and said end walls being hinged with hinge joints to other sides of the base;

said first side wall being completely removed from the base and said other of said side wall and said end walls being rotated about respective hinge joints to a position to lay down flat in an interior of the base in a first position of the side and end walls; and corner latches disposed in recessed pockets in said side walls wherein said corner latches join vertical edges of the first and second side walls to vertical edges of the end walls, respectively, to form corner joints in a second position of the side and end walls; and wherein said end walls have recesses corresponding to positions of said latches that open outwardly, and wherein each said latch has a pivoting latch bar that engages a corresponding said recess on an end wall, and further wherein each said latch has an operating handle for operating said latch bar to change a relative position of a pivot axis on which said pivoting latch bar pivots so that said pivot axis is positioned over center of a pivot axis of said handle in a latched position and wherein each edge of each of said end walls has a backing flange that extends from a top of the end wall downwardly about ⅔ of the length of each edge to permit bending of each of the end walls from the top down in forming the corners of the assembled container.

2. A container according to claim 1, wherein each said end wall has downwardly extending flanges that project downwardly from a bottom edge of the end wall that are received in pockets in the base to form the hinge joints, said end walls being pivoted about said respective hinge joints and erected first when starting assembly of said container from said first position, and then said second side wall being pivoted about said respective hinge joint into an erect position, followed by insertion of said first removable side wall into the side of the base in an erect position and latching of said first and second side walls to the end walls with said latches.

3. A container according to claim 2, wherein each of said end walls has an inside corner having a mortise and tenon joint that receives a corresponding flange along an outer vertical edge of said side wall to hold said side wall in an erect position prior to latching the corner joints with said latches.

4. A container according to claim 1, wherein said base has flanges that project upward from the side of the base to engage the first side wall for holding said first side wall in place for assembly of the corner joints prior to latching the corner joints with the latches.

5. A container according to claim 1, wherein in the first position, a plurality of said containers can be stacked, wherein the first position further includes that the end panels are positioned on top of the first and second side walls to support the base of a next upper stacked container.

6. A container according to claim 5, further including stacking rails that extend across ends of the base to which the end walls are hinged, said base having flanges that engage feet of the base of an upper stacked container for preventing side to side shifting.

7. A container according to claim 1, wherein said latch bar includes a pair of spaced arms and said pivot axis of said latch bar is formed from a pair of pins that protrude outwardly from said arms and are received in holes in said handle wherein the pins are locked into the holes when the latch is in the latched position.

8. A container according to claim 1, wherein said handle of said latch is rotated outwardly from said pocket for unlatching of said latch by disengaging the latch bar from the recess on the end wall.

9. A container according to claim 1, wherein each said pocket has a flange structure therein whereby when said latch bar is in a stored, disengaged position in said pocket, an end of said latch bar engages said flange structure to retain said latch bar in said pocket.

10. A container according to claim 7, wherein said arms of said latch bar are resilient whereby the arms are squeezed and the pins are popped into the holes in the handle when the arms are released to connect the latch bar to the handle when the latch is in an open position.

* * * * *